US011433360B2

(12) United States Patent
Gelderman et al.

(10) Patent No.: US 11,433,360 B2
(45) Date of Patent: Sep. 6, 2022

(54) DISPENSER AND SOLUTION DISPENSING METHOD

(71) Applicant: Ecolab USA Inc., St. Paul, MN (US)

(72) Inventors: Max Gelderman, St. Paul, MN (US); Daniel D. Anderson, Eagan, MN (US); Senta Riley, St. Paul, MN (US); Richard P. Oliphant, Inver Grove Heights, MN (US); Maxwell M. Johnson, Savage, MA (US); Brock Mueggenborg, Saint Paul, MN (US); Sonya S. Sharpe, Eagan, MN (US)

(73) Assignee: Ecolab USA Inc., Saint Paul, MN (US)

( * ) Notice: Subject to any disclaimer, the term of this patent is extended or adjusted under 35 U.S.C. 154(b) by 629 days.

(21) Appl. No.: 16/404,908

(22) Filed: May 7, 2019

(65) Prior Publication Data

US 2019/0336921 A1 Nov. 7, 2019

Related U.S. Application Data

(60) Provisional application No. 62/667,845, filed on May 7, 2018.

(51) Int. Cl.
*B01F 1/00* (2006.01)
*B01F 15/00* (2006.01)
(Continued)

(52) U.S. Cl.
CPC ..... *B01F 21/22* (2022.01); *B01F 21/30* (2022.01); *B01F 35/2217* (2022.01);
(Continued)

(58) Field of Classification Search
CPC ..... B01F 21/22; C02F 1/688
See application file for complete search history.

(56) References Cited

U.S. PATENT DOCUMENTS 2,820,701 A 1/1958 Leslie
3,089,508 A 5/1963 Schulze et al.
(Continued)

FOREIGN PATENT DOCUMENTS

CN 1787873 A 6/2006
DE 4336339 A1 4/1995
(Continued)

OTHER PUBLICATIONS

International Patent Application No. PCT/US2019/031022, International Search Report and Written Opinion dated Aug. 26, 2019, 15 pages.
(Continued)

*Primary Examiner* — Elizabeth Insler
(74) *Attorney, Agent, or Firm* — Fredrikson & Byron, P.A.

(57) ABSTRACT

A dispenser includes a dock configured to be fixed in place at a use device and a solid product holder configured to be removably secured to the dock. The dock has a first portion including a fixation element that is configured to fix the dock in place at the use device and a second portion including a receiving structure. The solid product holder includes a retaining structure, a base, and a support structure. The retaining structure is configured to removably secure the solid product holder to the receiving structure at the second portion of the dock. The base defines a plurality of apertures that form an open area at which the liquid is received at the solid product holder. The support structure extends from the base and defines an internal volume for holding the solid product at the solid product holder.

16 Claims, 12 Drawing Sheets

(51) Int. Cl.

| | |
|---|---|
| ***B01F 21/20*** | (2022.01) |
| ***B01F 21/00*** | (2022.01) |
| ***B01F 35/221*** | (2022.01) |
| *A47L 15/44* | (2006.01) |
| *B01F 101/48* | (2022.01) |
| *B01F 101/00* | (2022.01) |

(52) U.S. Cl.
CPC ..... *B01F 35/22162* (2022.01); *A47L 15/4436* (2013.01); *B01F 2101/4505* (2022.01); *B01F 2101/48* (2022.01)

(56) References Cited

U.S. PATENT DOCUMENTS

| | | | | |
|---|---|---|---|---|
| 3,474,817 | A | 10/1969 | Bates et al. | |
| 3,595,395 | A | 7/1971 | Lorenzen | |
| 3,595,438 | A | 7/1971 | Daley et al. | |
| 3,595,786 | A | 7/1971 | Horvath et al. | |
| 3,684,460 | A | 8/1972 | Arneson | |
| 3,696,333 | A | 10/1972 | Mott | |
| 3,831,205 | A | 8/1974 | Foley | |
| 4,250,911 | A | 2/1981 | Kratz | |
| 4,291,763 | A | 9/1981 | Singer | |
| 4,336,225 | A | 6/1982 | Hanford et al. | |
| 4,407,779 | A | 10/1983 | Thompson | |
| 4,426,362 | A | 1/1984 | Copeland et al. | |
| 4,462,511 | A | 7/1984 | Fulmer et al. | |
| 4,507,054 | A | 3/1985 | Schoenmeyr | |
| 4,569,781 | A | 2/1986 | Fernholz et al. | |
| 4,606,893 | A | 8/1986 | Sangster | |
| 4,687,121 | A | 8/1987 | Copeland | |
| 4,690,305 | A | 9/1987 | Copeland | |
| 4,770,859 | A | 9/1988 | Heiser, Jr. | |
| 4,795,061 | A | 1/1989 | Peckjian | |
| 4,826,661 | A | 5/1989 | Copeland et al. | |
| 4,830,509 | A | 5/1989 | Gulmatico | |
| 4,901,765 | A | 2/1990 | Poe | |
| 4,917,868 | A | 4/1990 | Alexander et al. | |
| 4,940,164 | A | 7/1990 | Hancock et al. | |
| 4,964,185 | A | 10/1990 | Lehn | |
| 4,999,124 | A | 3/1991 | Copeland | |
| 5,016,790 | A | 5/1991 | Thomas et al. | |
| 5,089,127 | A | 2/1992 | Junker et al. | |
| 5,100,032 | A | 3/1992 | Burdorf et al. | |
| 5,137,694 | A | 8/1992 | Copeland et al. | |
| 5,147,615 | A | 9/1992 | Bird et al. | |
| 5,183,206 | A | 2/1993 | Gavin | |
| 5,229,084 | A | 7/1993 | Livingston et al. | |
| 5,234,615 | A | 8/1993 | Gladfelter et al. | |
| 5,259,557 | A | 11/1993 | Spriggs et al. | |
| 5,268,153 | A | 12/1993 | Muller | |
| 5,310,430 | A | 5/1994 | McCall, Jr. | |
| 5,342,587 | A | 8/1994 | Laughlin et al. | |
| 5,374,119 | A | 12/1994 | Scheimann | |
| 5,384,102 | A | 1/1995 | Ferguson et al. | |
| 5,413,280 | A | 5/1995 | Taylor | |
| 5,417,233 | A | 5/1995 | Thomas et al. | |
| 5,427,748 | A | 6/1995 | Wiedrich et al. | |
| 5,505,915 | A | 4/1996 | Copeland et al. | |
| 5,536,479 | A | 7/1996 | Miller et al. | |
| 5,539,669 | A | 7/1996 | Goeckner et al. | |
| 5,542,583 | A | 8/1996 | Boyer et al. | |
| 5,584,327 | A | 12/1996 | Thomas et al. | |
| 5,607,651 | A | 3/1997 | Thomas et al. | |
| 5,638,285 | A | 6/1997 | Newton | |
| 5,849,253 | A | 12/1998 | Crossdale et al. | |
| 5,885,446 | A | 3/1999 | McGrew | |
| 5,915,592 | A | 6/1999 | Mehus et al. | |
| 5,928,608 | A | 7/1999 | Levesque et al. | |
| 6,059,536 | A | 5/2000 | Stingl | |
| 6,066,252 | A | 5/2000 | Reeves | |
| 6,138,703 | A | 10/2000 | Ferguson et al. | |
| 6,143,257 | A | 11/2000 | Spriggs et al. | |
| 6,147,599 | A | 11/2000 | Jones | |
| 6,158,673 | A | 12/2000 | Toetschinger et al. | |
| 6,254,267 | B1 | 7/2001 | Arnaud | |
| 6,257,000 | B1 | 7/2001 | Wang | |
| 6,517,727 | B2 | 2/2003 | Pickens et al. | |
| 6,531,056 | B2 | 3/2003 | Hammonds | |
| 6,871,674 | B2 | 3/2005 | Thomas et al. | |
| 6,895,771 | B1 * | 5/2005 | Cantolino | B01F 25/4231 62/288 |
| 7,029,578 | B2 | 4/2006 | Spruce | |
| 7,081,232 | B1 | 7/2006 | Dooley, Jr. et al. | |
| 7,228,066 | B2 | 6/2007 | Pope | |
| 7,300,196 | B2 | 11/2007 | Fleig | |
| 7,331,488 | B2 | 2/2008 | Naslund et al. | |
| 7,351,386 | B2 | 4/2008 | Halstead et al. | |
| 7,452,122 | B2 | 11/2008 | Lin | |
| 8,007,664 | B2 * | 8/2011 | Reed | C02F 1/008 116/281 |
| 8,286,831 | B2 | 10/2012 | Blansit et al. | |
| 8,518,271 | B2 | 8/2013 | Lane et al. | |
| 9,352,979 | B2 | 5/2016 | Kuennen et al. | |
| 9,643,143 | B2 * | 5/2017 | Schultz | B01F 21/30 |
| 9,663,691 | B2 | 5/2017 | Adams | |
| 9,668,508 | B2 | 6/2017 | Chandra et al. | |
| 9,901,884 | B2 | 2/2018 | Carroll et al. | |
| 10,065,156 | B2 | 9/2018 | Carroll et al. | |
| 2003/0085239 | A1 | 5/2003 | Crain et al. | |
| 2004/0255988 | A1 | 12/2004 | DuHack et al. | |
| 2005/0072800 | A1 | 4/2005 | Smith | |
| 2005/0129596 | A1 | 6/2005 | Barani | |
| 2005/0150489 | A1 | 7/2005 | Dunfield et al. | |
| 2005/0244315 | A1 | 11/2005 | Greaves et al. | |
| 2006/0243743 | A1 | 11/2006 | Mehus et al. | |
| 2006/0280292 | A1 | 12/2006 | McCarthy | |
| 2007/0018010 | A1 | 1/2007 | Mehus et al. | |
| 2007/0034644 | A1 | 2/2007 | Bertucci et al. | |
| 2007/0170102 | A1 | 7/2007 | Barani | |
| 2007/0228075 | A1 | 10/2007 | Edwards et al. | |
| 2008/0010983 | A1 | 1/2008 | Morgan et al. | |
| 2008/0035765 | A1 | 2/2008 | Kubby et al. | |
| 2008/0152556 | A1 | 6/2008 | Brandreth | |
| 2008/0217258 | A1 | 9/2008 | Buchan | |
| 2010/0226835 | A1 | 9/2010 | Carroll et al. | |
| 2011/0094949 | A1 | 4/2011 | Just | |
| 2012/0138544 | A1 | 6/2012 | Barani | |
| 2012/0145618 | A1 | 6/2012 | Kuennen et al. | |
| 2014/0110352 | A1 | 4/2014 | King et al. | |
| 2014/0217038 | A1 | 8/2014 | Lane et al. | |
| 2015/0183672 | A1 * | 7/2015 | Washburn | C02F 5/10 210/85 |
| 2017/0217804 | A1 | 8/2017 | Buchan | |

FOREIGN PATENT DOCUMENTS

| | | | |
|---|---|---|---|
| EP | 863278 | A2 | 9/1998 |
| EP | 1428799 | A2 | 6/2004 |
| EP | 1920697 | A1 | 5/2008 |
| EP | 2964581 | A1 | 1/2016 |
| GB | 1431557 | A | 4/1976 |
| GB | 2016088 | A | 9/1979 |
| WO | 9107907 | A1 | 6/1991 |
| WO | 2008115203 | A1 | 9/2008 |
| WO | 2009106476 | A1 | 9/2009 |
| WO | 2010100617 | A2 | 9/2010 |

OTHER PUBLICATIONS

Tablet Feeder for Chorination/Dechlorination, Norweco LF, Retrieved from <http://www.promagenviro.com/Norweco-LF-Tablet-Feeder> on Dec. 12, 2017, 2 pages.

* cited by examiner

DISPENSER AND SOLUTION DISPENSING METHOD

CROSS REFERENCE TO RELATED APPLICATION

This application claims the benefit of U.S. Provisional Patent Application No. 62/667,845 filed May 7, 2018. The entire content of this application is incorporated herein by reference.

TECHNICAL FIELD

This disclosure generally relates to solution dispensers and related methods for dispensing a solution. More specifically, this disclosure relates to dispensers, and related methods, for creating a solution by dissolving a solid product with a liquid.

BACKGROUND

A dispenser is employed to output a solution for use in a particular application. A number of different types of facilities employ dispensers for everyday applications. Such facilities can be found, for example, in the health care, food and beverage, and sanitation industries. The particular application in which the solution output by the dispenser is used varies across industries depending of the type of use device receiving the output solution. For instance, the use device can be a warewashing or laundry machine and the dispenser can be used to output a cleaning or sanitizing solution for utilization at the use device.

Generally, a dispenser can hold a concentrated chemistry and receive water from a plumbed, pressurized water feed line. The dispenser then mixes this water with the concentrated chemistry to produce a solution that includes the chemistry. However, currently available dispensers may be unable to provide appropriate control over the amount of chemistry that is intermixed with the received water, thus impacting the concentration of the chemistry within the output solution. Accordingly, this can result in the dispenser outputting a solution with an undesirable amount of chemistry. For instance, when such a dispenser outputs a solution with a greater concentration of chemistry than desired, the chemistry can be used up quicker than necessary and, in some cases, items at the use device receiving the solution may be subject to unnecessarily high concentrations of the chemistry. This can, in turn, increase costs associated with the particular application for which the dispenser is being used. On the other hand, when such a dispenser outputs a solution with a lesser concentration of chemistry than desired, the particular application in which the dispenser is being used may not be performed as desired. Moreover, use of the plumbed water feed line associated with the dispenser may increase user burden associated with the dispenser.

SUMMARY

In general, various exemplary embodiments relating to dispensers, and related methods, for creating a solution by dissolving a solid product with a liquid are disclosed herein. As compared to previous dispensers, various embodiments disclosed herein can be useful, for instance, in providing more effective control over the amount of chemistry that is released and thus present in the output solution. This, in turn, can provide a more cost-effective dispenser while also allowing for increased optimization of the output solution as selected for a particular application. In addition, various embodiments disclosed herein can provide an easy-to-use dispenser. For instance, certain dispenser embodiments can be conveniently reloaded with the solid product to provide a user-friendly, reusable solution dispensing function that can be used for multiple cycles at an associated use device. Furthermore, in some cases, embodiments disclosed herein can be used internally within a use device and utilize an already existing fluid supply, such as a water spray, within the use device. In such an embodiment, the dispenser can be designed to operate effectively without having a dedicated water feed line connected thereto.

One exemplary embodiment includes a dispenser for creating a solution by dissolving a solid product with a liquid. The dispenser includes a dock and a solid product holder. The dock is configured to be fixed in place at a use device and the solid product holder is configured to be removably secured to the dock. The dock has a first portion including a fixation element that is configured to fix the dock in place at the use device and a second portion including a receiving structure. The solid product holder includes a retaining structure, a base, and a support structure. The retaining structure is configured to removably secure the solid product holder to the receiving structure at the second portion of the dock. The base defines a plurality of apertures that form an open area at which the liquid is received at the solid product holder. The support structure extends from the base and defines an internal volume for holding the solid product at the solid product holder.

In a further exemplary embodiment, the base of the dispenser can include a first plate and a second plate. The first plate defines a first set of the plurality of apertures and the second plate defines a second set of the plurality of apertures. The second plate is movable at the solid product holder relative to the first plate. In such an embodiment, the base can be configured to adjust the open area at which the liquid is received at the solid product holder by movement of the second plate relative to the first plate. In one particular example, the dispenser can further include an open area adjustment device. The open area adjustment device can have a power source, a motor connected to the power source, and a drive member driven by the motor and interfacing with the second plate. The drive member, when driven, is configured to move the second plate relative to the first plate so as to adjust the open area at which the liquid is received at the solid product holder.

Another exemplary embodiment includes a method of creating a solution by dissolving a solid product with a liquid. The method includes the step of loading the solid product into a solid product holder. The solid product holder has a base defining a plurality of apertures that form an open area at which the liquid is received at the solid product holder and a support structure that extends from the base and defines an internal volume for holding the solid product at the solid product holder. A width of the internal volume can approximate a width of the solid product such that the liquid received at the open area is limited to confronting a surface of the solid product interfacing with the open area. The method also includes the step of securing a retaining structure of the solid product holder to a receiving structure of a dock. The dock has a first portion that includes a fixation element for fixing the dock in place at a use device and a second portion that includes the receiving structure. The method further includes the step of receiving a liquid from the use device at the internal volume through the open area. The liquid can dissolve the surface of the solid product interfacing with the open area. The method additionally includes the steps of outputting the solution at the open area and removing the solid product holder from the dock by unsecuring the retaining structure of the solid product holder from the receiving structure of the dock.

The details of one or more examples are set forth in the accompanying drawings and the description below. Other features, objects, and advantages will be apparent from the description and drawings.

BRIEF DESCRIPTION OF THE DRAWINGS

The following drawings are illustrative of particular embodiments of the present invention and therefore do not limit the scope of the invention. The drawings are intended for use in conjunction with the explanations in the following description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, and/or dimensions are provided for selected elements. Those skilled in the art will recognize that many of the noted examples have a variety of suitable alternatives.

Figure 1:
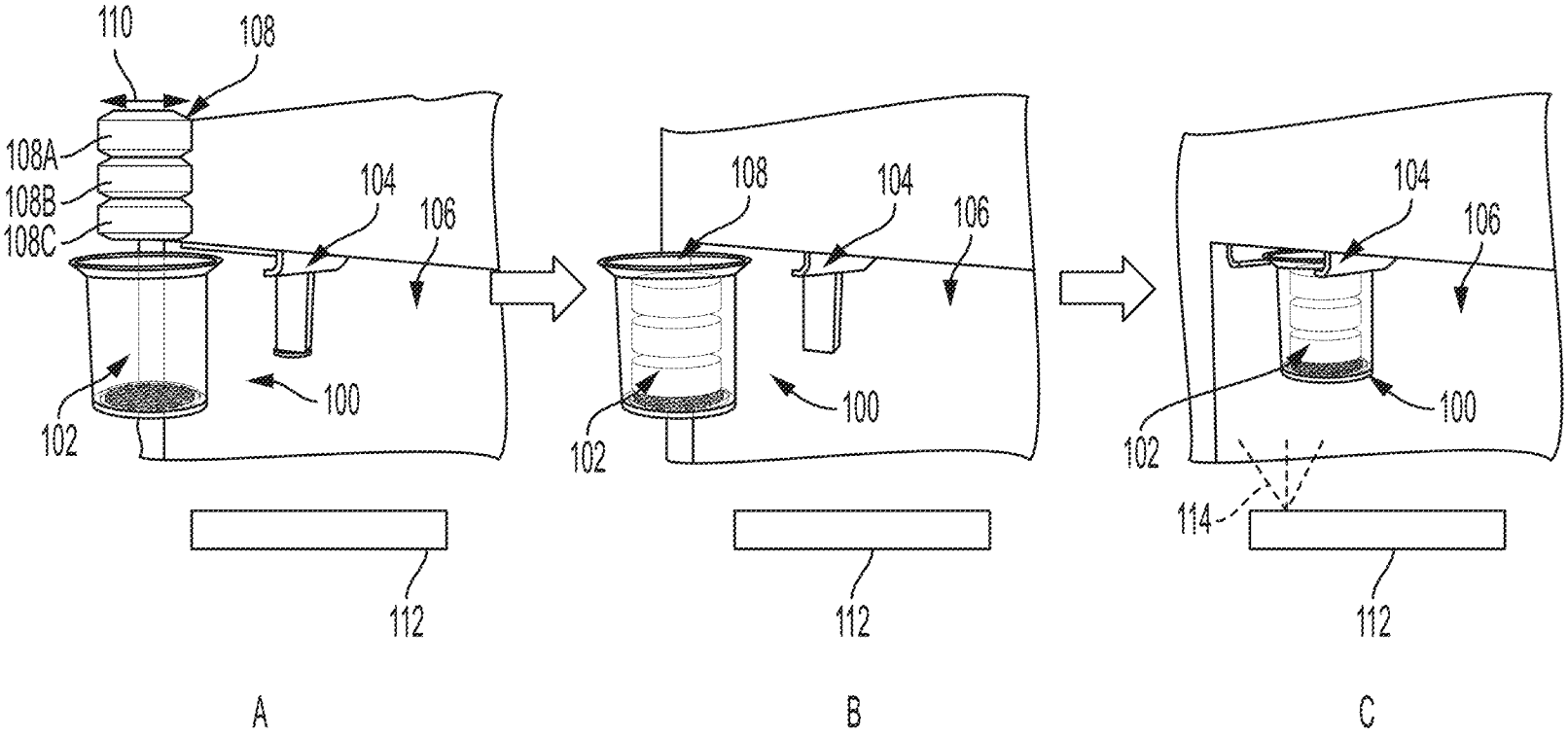
FIG. 1 is a diagram illustrating a sequence involving an exemplary embodiment of a dispenser. Each of FIGS. 1A, 1B, and 1C illustrates a portion of the sequence for ultimately removably securing a solid product holder of the dispenser to a dock of the dispenser.

FIG. 1 shows a diagram illustrating a sequence involving an exemplary embodiment of a dispenser 100. The dispenser 100 includes a solid product holder 102 and a dock 104. FIG. 1 shows a sequence of removably securing the solid product holder 102 of the dispenser 100 to the dock 104 of the dispenser 100. The dispenser 100 can be used to create a solution by dissolving a solid product 108 with a liquid. This solution can be output from the dispenser 100 to a use device 106 and employed in an operation run at the use device 106. The use device 106 can be any of a variety of devices that employ a solution as part of an operation run at the use device 106.

At portion A of the sequence shown in FIG. 1, solid product 108 is loaded into the solid product holder 102 where the solid product 108 is held. At least one of the dock 104 and the solid product holder 102 can include a transparent surface so that the solid product held at the dispenser 100 is visible therethrough. The solid product 108 can be a solid-form chemistry used in one or more operations run at the use device 106. The type of chemistry included in the solid product 108 can vary depending on the use device 106 with which the dispenser 100 is intended to be used. For instance, in an example where the use device 106 is a warewashing or laundry machine the solid product 108 may be a solid-form detergent. As one such example, the solid product 108 could be a chemistry that includes a cleansing source of alkalinity, a rinsing source of nonionic and may contain additional ingredients such as surfactants, rinse agents, builders, hardness sequestering agents, etc.

The solid product 108 is shown in the example here in the form of a number of individual solid product pucks 108A, 108B, and 108C. The solid product holder 102 may be configured to hold two or more solid product pucks, such as each of the solid product pucks 108A, 108B, and 108C. As shown in the example here, the solid product holder 102 can be configured to hold the solid product pucks 108A, 108B, and 108C in a stacked arrangement along a generally common axis extending through the solid product holder 102. For instance, the solid product pucks 108A, 108B, and 108C can each have a width 110. The solid product holder 102 can have an internal volume for holding the solid product 108 that accommodates only one solid product puck width 110 thereacross such that the solid product pucks 108A, 108B, and 108C are loaded into the solid product holder 102 one on top of the other on the common axis extending through the solid product holder 102. In this way, the solid product holder 102 can be configured to hold enough chemistry for use during multiple cycles over multiple operations at the use device, which may reduce the number of times a user needs to reload the dispenser as compared to single-cycle product capacity type dispensers. This can also reduce the chance that a wash cycle intended to employ chemistry is inadvertently run without chemistry present at the dispenser as may be more likely to occur with single-cycle product capacity type dispensers.

At portion B of the sequence shown in FIG. 1, after the solid product 108 is loaded into the solid product holder 102, the solid product holder 102 can be removably secured to the dock 104. As shown here, the dock 104 is configured to be fixed in place at the use device 106. In the illustrated example, the dock 104 is configured to be fixed in place within an interior of the use device 106. The solid product holder 102 can be moved relative to the dock 104 to removably secure the solid product holder 102 at the dock 104. In the illustrated embodiment, after the solid product holder 102 is appropriately aligned with the dock 104, the solid product holder 102 is removably secured to at the dock 104 by sliding the solid product holder 102 relative to the dock 104. As detailed further herein, the dock 104 can include one or more features configured to receive and secure the solid product holder 102 at the dock 104 as well as to allow the solid product holder 102 to be selectively released from the dock 104 when desired (e.g., to refill the solid product holder 102 with solid product 108).

At portion C of the sequence shown in FIG. 1, the solid product holder 102 is secured to the dock 104. As shown here, the dock 104 is configured to be fixed in place within the use device 106 and, accordingly, when the solid product holder 102 is secured to the dock 104 the solid product holder 102 is also configured to be secured within the use device 106. In this way, the dispenser 100 can output a solution within the use device 106. For instance, the solid product holder 102 can receive a liquid, such as water, from the interior of the use device 106 and the solid product 108 held at the solid product holder 102 can be dissolved by the received liquid to create the solution that is output within the use device 106 from the dispenser 100. In various embodiments, the dispenser 100 can receive liquid that is freely employed (e.g., sprayed) within the use device 106 and as such the dispenser 100 need not have a dedicated liquid feed line connected to it. Accordingly, the dispenser 100 may be configured to create a solution by dissolving the solid product with a liquid without the dispenser 100 being connected to a plumbed liquid feed line. In some cases, the dispenser can be configured to have a plurality of apertures at the base interfacing directly with the ambient environment of the use device as well as one or more continuous surfaces at all other exterior surfaces of the dispenser (e.g., all exterior surfaces, but for the location of the plurality of apertures at the base, as defined when the solid product holder is secured to the dock) that shield that the internal volume, where the solid product is held, from receiving liquid input.

For illustrative purposes, the present disclosure uses the example of a warewashing machine as the use device 106, though in other instances the use device 106 can be a number of various other solution-employing devices. In examples where the use device 106 is a warewashing machine, the warewashing machine can include a spray arm 112 within the use device 106. The spray arm 112 can output a pressurized liquid spray 114 within the use device 106 and the dispenser 100, positioned within the use device 106, can receive the pressurized liquid spray 114 from the spray arm 112 as shown at portion C of the sequence in FIG. 1. Accordingly, the dispenser 100 can be configured to receive liquid spray 114 that is first output into the ambient environment within the use device 106 and then received at the dispenser 100. As the dispenser 100 receives the pressurized liquid spray 114 present within the use device 106, the solid product 108 held at the solid product holder 102 is dissolved and the solution, including the chemistry of the solid product 108, is output into the use device 106 from the dispenser 100 and can be used to clean and/or sanitize wares loaded into the use device 106. In this way, the dispenser 100 can receive liquid already being employed within the ambient environment of the use device 106 during an operation run at the use device 106.

In examples where the use device 106 is a warewashing machine, the warewashing machine can run an operation that includes a number of different cycles. For instance, some warewashing machines run one or more wash cycles followed by one or more rinse cycles. The wash cycle(s) are intended to perform a different function than the rinse cycle(s) and, therefore, conditions within the use device can vary depending on the particular cycle in an operation. For instance, a volume of pressurized liquid spray 114 output from the spray arm 112 can vary throughout the duration of an individual cycle and/or from one cycle to another. As detailed further herein, the dispenser 100 can allow for control over the solution dispensed therefrom so that the dispenser 100 can be adjusted to appropriately suit the particular operational conditions of the use device 106 (e.g., throughout the duration of a cycle and/or from one cycle to the next). As one example, the dispenser 100 can provide a degree of control over the amount of chemistry present in the output solution by adjusting the amount of liquid that is able to be received within the dispenser 100.

Figure 2:
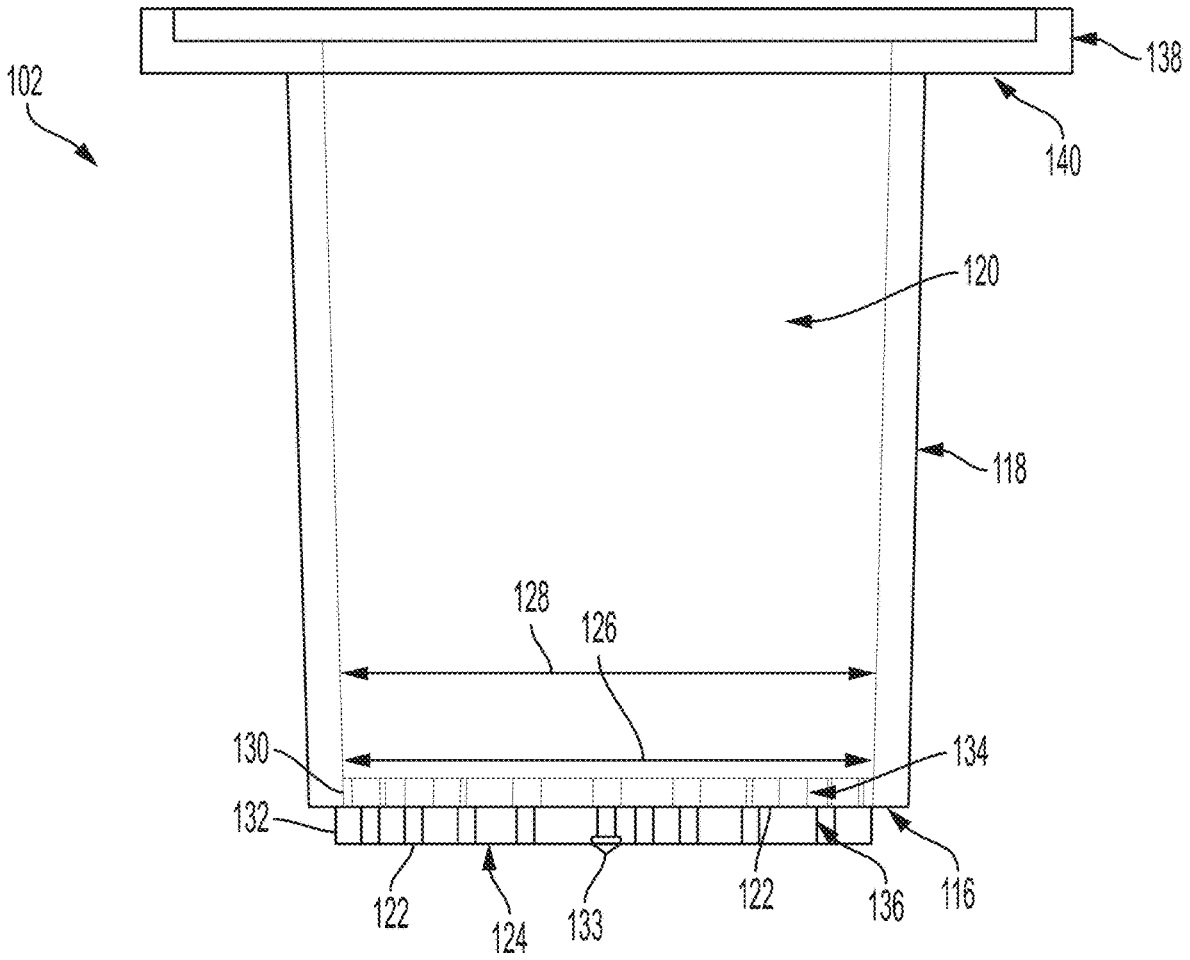
FIG. 2 is an elevational view of the solid product holder of the dispenser of FIG. 1 in isolation.

FIG. 2 shows an elevational view of the solid product holder 102 of the dispenser 100 of FIG. 1 in isolation. As noted, the solid product holder 102 can be configured to hold solid product and receive liquid thereat to dissolve the solid product and output a solution including chemistry of the solid product. The solid product holder 102 can include a base 116 and a support structure 118. The support structure 118 can extend from the base 116 and define an internal volume 120 for holding the solid product at the solid product holder 102. In the illustrated embodiment, the support structure 118 is a continuous surface extending about a perimeter of the base 116 and can be a transparent surface so that the solid product held within is visible through the support structure 118. In the illustrated embodiment, the support structure 118 is a solid, continuous surface at all locations around its perimeter such that no apertures exist in the support structure 118. The base 116 can define a plurality of apertures 122 that form an open area 124 at which the liquid is received at the solid product holder 102. In this example, the internal volume 120 can be further defined by the base 116 such that the solid product holder 102 is configured to communicate the received liquid through the plurality of apertures 122 into the internal volume 120 where the solid product is held and dissolved when the liquid is received therein. In addition, the solid product holder 102 may be configured to output the solution at the plurality of apertures 122 such that the open area 124 formed by the plurality of apertures 122 can serve as an outlet area for the created solution.

The solid product holder 102 can be configured to facilitate generally even dissolution across an exposed surface of the solid chemistry (e.g., a bottom surface of the bottom-most solid chemistry puck) using the liquid received at the open area 124. When the solid product is held at the solid product holder 102 within the internal volume 120, generally the solid product holder 102 is configured to limit dissolution to only that surface of the solid product sitting at the base 116 (e.g., at the plurality of apertures 122) and to facilitate generally uniform dissolution across that surface of the solid product sitting at the base 116. For instance, the plurality of apertures 122 can be defined across a first cross-sectional area 126 of the base 116 and the internal volume 120 can be defined across a second cross-sectional area 128 of the support structure 118. In this example, the first cross-sectional area 126 approximates, and in one case can be equal to, the second cross-sectional area 128. In one case, the first cross-sectional area 126 can be equal to approximately 95%, 90%, 85%, 80%, or 75% of the second cross-sectional area 128 that is taken at the midway point along the height of the support structure 118. Thus, since the internal volume 120 can be sized to accommodate the solid product width thereacross, when the solid product is held within the internal volume 120 the apertures 122 are defined along a cross-sectional area that is generally coextensive with the solid product width. In this way, the first cross-sectional area 126 may not be located substantially outside of the solid product width nor substantially inside of the solid product width. This may be useful in facilitating even dissolution along the surface of the solid chemistry sitting at the base 116.

In addition, the solid product holder 102 can be configured to facilitate control over the amount of chemistry present in the output solution by adjusting the amount of liquid that is received within the internal volume 120 via the open area 124. As shown in the illustrated embodiment, the base 116 can include a first plate 130 and a second plate 132. The second plate 132 can be movable at the solid product holder 102 relative to the first plate 130. For instance, the first plate 130 can be fixed relative to the support structure 118 and the second plate 132 can be rotatable relative to the first plate 130 about a rotational axis 133. By moving the second plate 132 relative to the first plate 130, a degree to which the apertures 122 of the respective plates 130, 132 are aligned can be adjusted to correspondingly alter the open area 124 at which the liquid is received at the solid product holder 102.

The first plate 130 can define a first set 134 of the plurality of apertures 122 and the second plate 132 can define a second set 136 of the plurality of apertures 122. Depending on the application in which the dispenser is intended for use, the distribution of the plurality of apertures 122 in the first set 134 can be the same as or different than the distribution of the plurality of apertures 122 in the second set 136. For example, in one embodiment, the plurality of apertures 122 in the first set 134 is distributed evenly across the first plate 130 and the plurality of apertures 122 in the second set 136 is distributed evenly across the second plate 132 such that an open area defined at the first plate 130 is equal to an open area defined at the second plate 132. In another embodiment, the plurality of apertures 122 in the first set 134 can be distributed evenly across the first plate 130 and the plurality of apertures 122 in the second set 136 can be distributed evenly across the second plate 132 but an open area defined at the first plate 130 is different than an open area defined at the second plate 132 because, for instance, there are more apertures 122 at one the plates 130, 132 and/or the size of the apertures at one plate 130, 132 differs from the size of the apertures at another plate 130, 132.

Moving the second plate 132 relative to the first plate 130 can vary alignment between the first set 134 of the plurality of apertures 122 and the second set 136 of the plurality of apertures 122 and thereby adjust the open area 124 at the base 116 of the solid product holder 102. As such, the base 116 can be configured to adjust the open area 124 at which the liquid is received at the solid product holder 102 by movement of the second plate 132 relative to the first plate 130. In turn, by adjusting the open area 124 the amount of solid product dissolved by the received liquid at the open area 124 can be controlled and, consequently the amount of chemistry present in the output solution can be controlled. This can be useful for configuring the dispenser appropriately for the conditions at a particular use device since use device conditions can vary widely across different types of devices and/or across different facilities employing the same use device. In one example, adjusting the open area 124 could close off the open area 124 to prevent ingress of fluid thereat, which may be appropriate where a particular use device cycle is not intended to employ chemistry held at the dispenser.

As also noted, the solid product holder 102 can be configured to be removably secured to the dock of the dispenser. As shown in the exemplary embodiment in FIG. 2, the solid product holder 102 can include a retaining structure 138 that is configured to removably secure the solid product holder 102 to the dock. In this example, the retaining structure 138 includes a catch 140 for interfacing with the dock and facilitating a secure yet removable connection between the solid product holder 102 and the dock. Here, the catch 140 can extend radially around some, or all, of the solid product holder 102. In embodiments where the catch 140 extends radially around all of the solid product holder 102, it may be more convenient for a user to secure the solid product holder 102 to the dock since the solid product holder 102 can be secured to the dock regardless of the angular orientation of the solid product holder 102. The retaining structure 138 may be at an opposite end of the solid product holder 102 from the base 116 and the support structure 118 can extend between the retaining structure 138 and the base 116.

Figure 3:
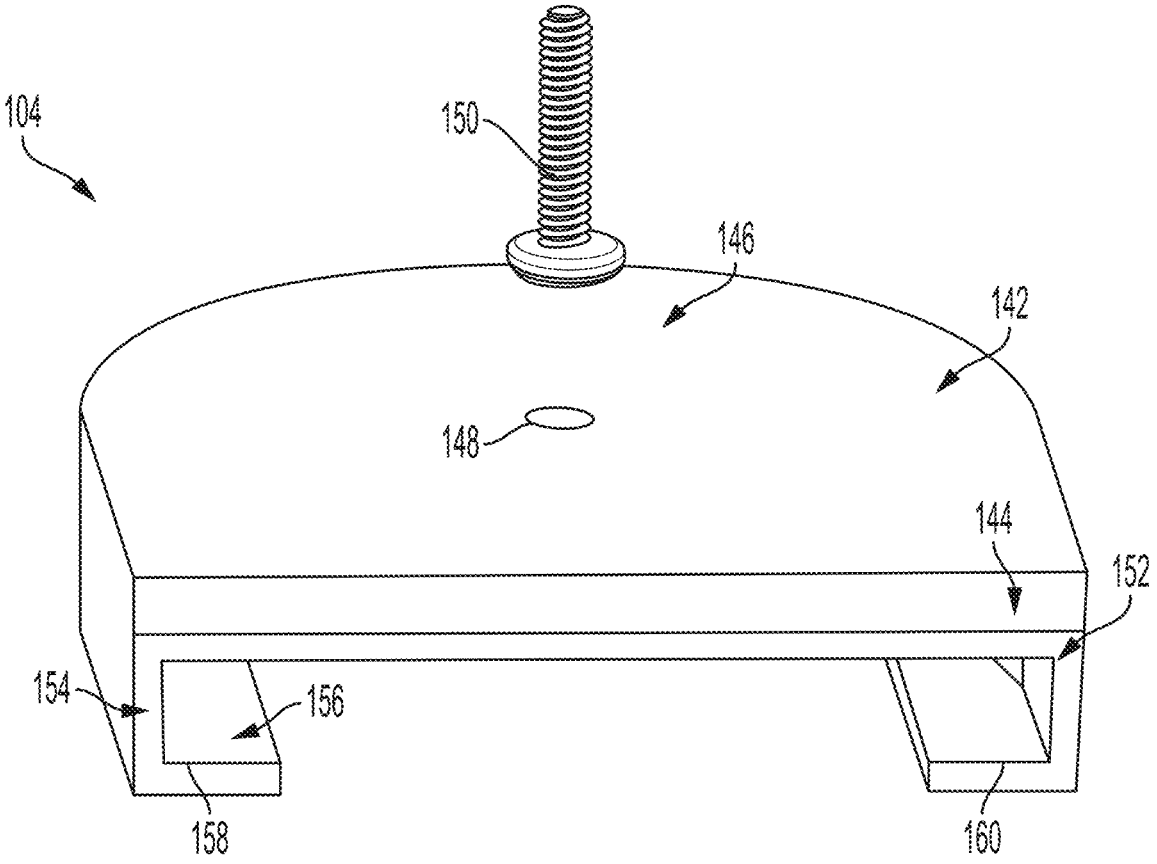
FIG. 3 is a perspective view of the dock of the dispenser of FIG. 1 in isolation.

FIG. 3 shows a perspective view of the dock 104 of the dispenser 100 of FIG. 1 in isolation. The dock 104 can have a first portion 142 and a second portion 144. In the illustrated example, the first portion 142 is a first surface of the dock 104 and the second portion 144 is a second, opposite surface of the dock 104. In some cases, the first portion 142 and the second portion 144 can be integral portions of a single piece dock.

As noted previously, the dock 104 can be configured to be fixed in place at the use device. The first portion 142 of the dock 104 can include a fixation element 146 that is configured to fix the dock 104 in place at the use device. In the illustrated example, the fixation element 146 includes a fixation bore 148 and a fastener 150. The fixation bore 148 can extend into, and in some cases through, the first portion 142 of the dock 104. The fastener 150 can be received at the fixation bore 148 and be configured to extend into, and thereby fix the dock 104 at, a surface of the use device. A sealing member, such as gasket, may also be included at an interface of the fastener 150 and fixation bore 148. The fastener 150 is shown in the illustrated example as a screw and the fixation bore 148 can include threading along a length thereof corresponding to threading on the screw to allow relative fixation. Although a screw is shown here as an example of the fastener 150, any one of a variety of suitable fasteners for securing the dock 104 at the use device could be used, such as a magnet, interference fit member, or other appropriate securement component. If, for instance, a magnet were used as the fixation element 146 to fix the dock 104 in place at the use device, the dock 104 could be removable from the use device when refilling the solid product holder and then the dock 104 and the solid product holder could be secured and placed within the use device together using the magnet as the fixation element 146.

As also noted previously, the dock 104 can be configured to removably secure the solid product holder thereat. The second portion 144 of the dock 104 can include a receiving structure 152 at which the retaining structure of the solid product holder can be removably secured. In the illustrated embodiment, the receiving structure 152 includes a flange 154 that extends out from the second portion 144 of the dock 104. The flange 154 can form a track surface 156 at a location along the flange 154 that is spaced from the second portion 144. The track surface 156 can include a first track surface end 158 and a second track surface end 160. The track surface 156 can extend from the first track surface end 158 to the second track surface end 160. The catch of the retaining structure of the solid product holder can be configured to sit on this track surface 156, for instance by initially coming into contact with the first track surface end 158 and the second track surface end 160 and being movable along the track surface 156, from the first track surface end 158 and the second track surface end 160, to a securing location at the track surface 156.

Figure 4:
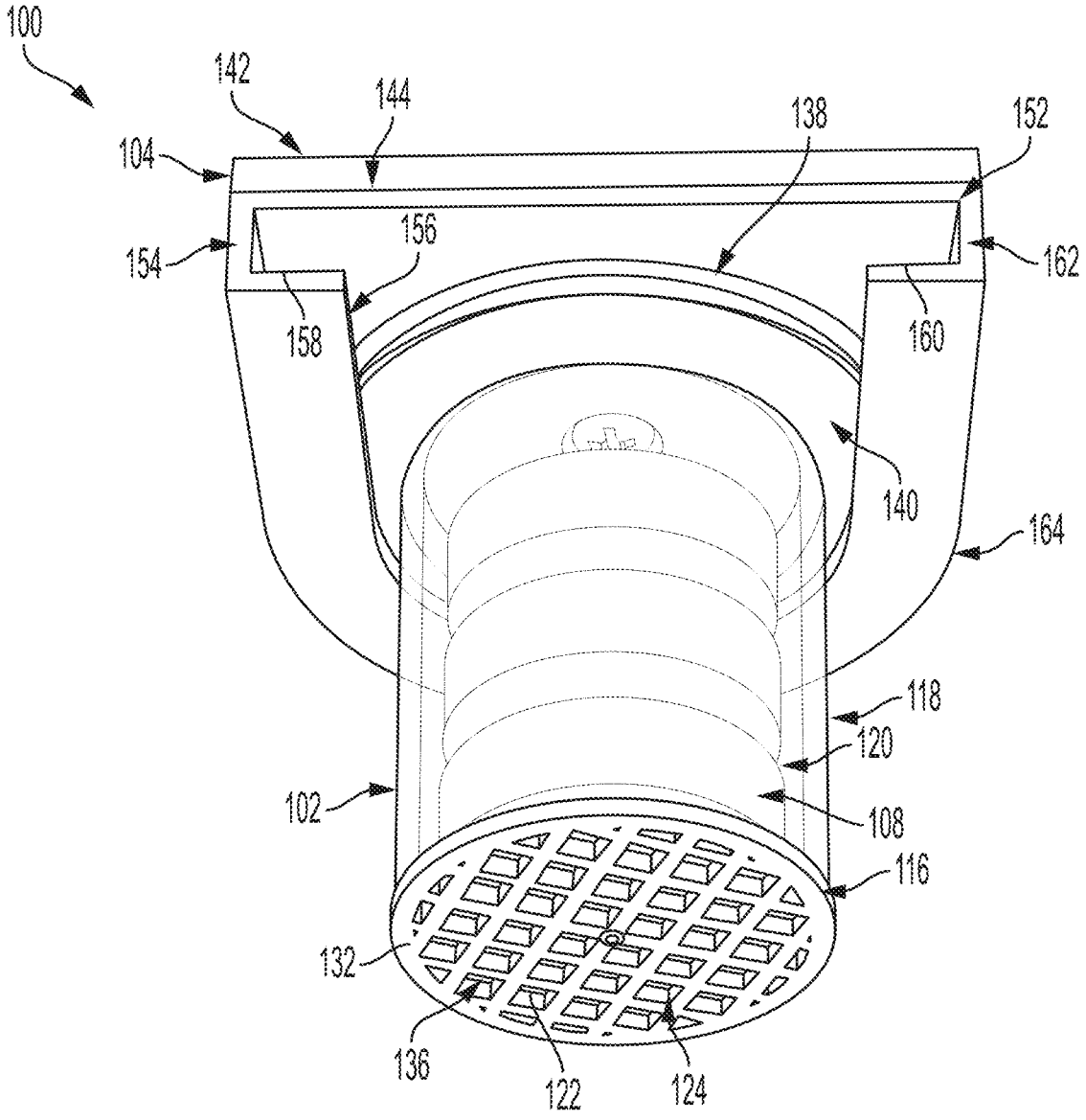
FIG. 4 is a perspective view of an exemplary embodiment of the dispenser of FIG. 1 showing the solid product holder secured to the dock.

FIG. 4 shows a perspective view of the exemplary embodiment of the dispenser 100 of FIG. 1 with the solid product holder 102 secured to the dock 104. As shown here, the retaining structure of the solid product holder 102 is secured to the receiving structure of the dock 104. In particular, in this embodiment, the catch 140 of the solid product holder 102 is secured at the flange 154 on the track surface 156. The flange 154 can form an opened flange end 162 and a closed flange end 164 that are, for instance, at, or near, opposite ends of the dock 104. The first track surface end 158 and the second track surface end 160 may each be at the opened flange end 162, as shown here. In this way, the track surface 156 may be a continuous surface that extends from the first track surface end 158, at the opened flange end 162, to the closed flange end 164 and to the second track surface end 160, at the opened flange end 162. When the solid product holder 102 is to be secured to the dock 104, the catch 140 can be aligned with the flange 154 at the opened flange end 162. Then, the catch 140 can be sat onto the track surface 156 and the catch 140 can be slid along the track surface 156 from the opened flange end 162 toward the closed flange end 164. Likewise, when the solid product holder 102 is to be removed from the dock 104, for instance to refill the solid product holder 102, the catch 140 can be slid along the track surface 156 in a direction toward the opened flange end 162.

Figure 5:
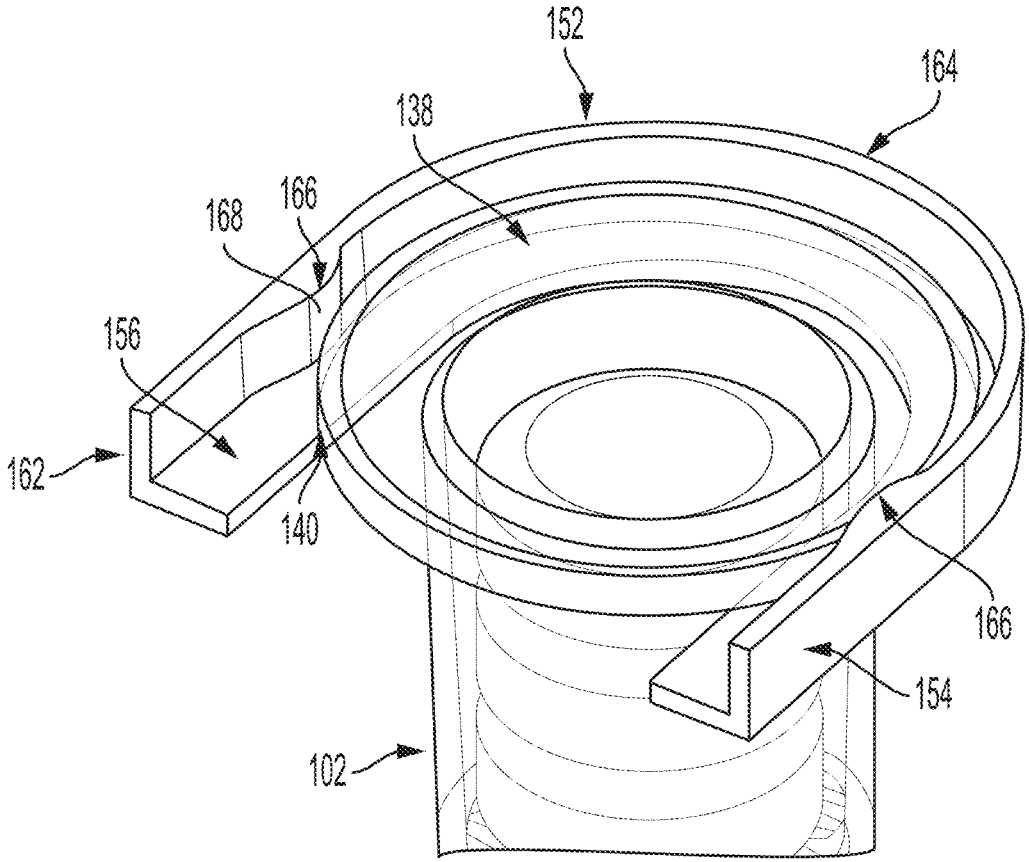
FIG. 5 is a perspective view of the dispenser of FIG. 1 with a portion of the dock removed to illustrate an exemplary embodiment of a receiving structure of the dock.

FIG. 5 shows a perspective view of a portion of the dispenser of FIG. 1. Namely, in FIG. 5 a portion of the dock is removed to illustrate certain exemplary features of the dock's receiving structure 152 which in FIG. 5 has the retaining structure 138 of the solid product holder 102 secured thereat.

To facilitate securement of the solid product holder 102 at the dock, the receiving structure 152 can include one or more locking mechanisms 166. In the illustrated embodiment, two locking mechanisms 166 are included on the flange 154 of the receiving structure 152. Each locking mechanism 166 is shown here at a location along the track surface 156 between the opened flange end 162 and the closed flange end 164. Each locking mechanism 166 can be configured to secure the solid product holder 102 to the dock when the retaining structure 138 of the solid product holder 102 is moved along the track surface 156. For instance, each locking mechanism 166 can be configured to secure the solid product holder 102 to the dock when the retaining structure 138 is moved along the track surface 156 (e.g., in a direction from the opened flange end 162 toward the closed flange end 164) and past the locking mechanism 166. Also, each locking mechanism 166 can be configured to unsecure the solid product holder 102 from the dock upon the retaining structure 138 being brought into contact with the locking mechanism 166 (e.g., by bringing the retaining structure 138 along the track surface 156 in a direction from the closed flange end 164 toward the opened flange end 162). Moreover, the locking mechanisms 166 may help to keep the solid product holder 102 in place at the dock during operation of the use device, which may include the ability to withstand vibrational forces imparted onto the dispenser during operation of the use device.

As one example shown here, the locking mechanism 166 can include an arm 168. The arm 168 can be biased, for instance by a spring or other appropriate biasing component, to a position that extends into the track surface 156. When securing the solid product holder 102 at the dock, as the retaining structure 138 is moved along the track surface 156 and brought into contact with the arm 168, the retaining structure 138 can overcome the bias force on the arm 168 and move the arm 168 from its position extending into the track surface 156. For instance, the arm 168 may be moved into a recess in the flange 154. This can allow the retaining structure 138 to move past the locking mechanism 166. Then, as the retaining structure 138 moves past the locking mechanism 166 and out of contact with the locking mechanism 166, the bias force on the arm 168 can bring the arm 168 back to its position extended into the track surface 156. This can help to secure the solid product holder 102 at the dock. And, when the solid product holder 102 is to be removed from the dock, the retaining structure 138 can be brought into contact with the arm 168, move the arm 168 from its position extending into the track surface 156, and allow the retaining structure 138 to move along the track surface 156 and away from the receiving structure 152. Moreover, the use of a biased arm may be able to provide a user who is securing the solid product holder 102 to the dock with a tactile (e.g., snap) or other indication that the solid product holder 102 has been successfully secured to the dock.

In other examples, the locking mechanism 166 can take a number of other various configurations suitable for securing the solid product holder 102 at the dock. For instance, the locking mechanism 166 could include an elevational change along the track surface 156. Such an elevational change could be the form of an elevational drop at the track surface 156 moving in a direction from the opened flange end 162 toward the closed flange end 164. Such an elevational change could alternatively be in the form of an elevational increase at the track surface 156, for instance that is followed by an elevational drop (e.g., back to the elevation of the track surface 156 prior to the elevational increase). Where the locking mechanism 166 includes an elevational change along the track surface 156, this can act to create an interference fit for the retaining structure 138 at the track surface 156 as the retaining structure 138 is moved along the track surface 156 past the elevational change. And, this interference fit can to help secure the retaining structure 138 at the dock while allowing the retaining structure 138 to be selectively removed from the receiving structure 152.

Figure 6:
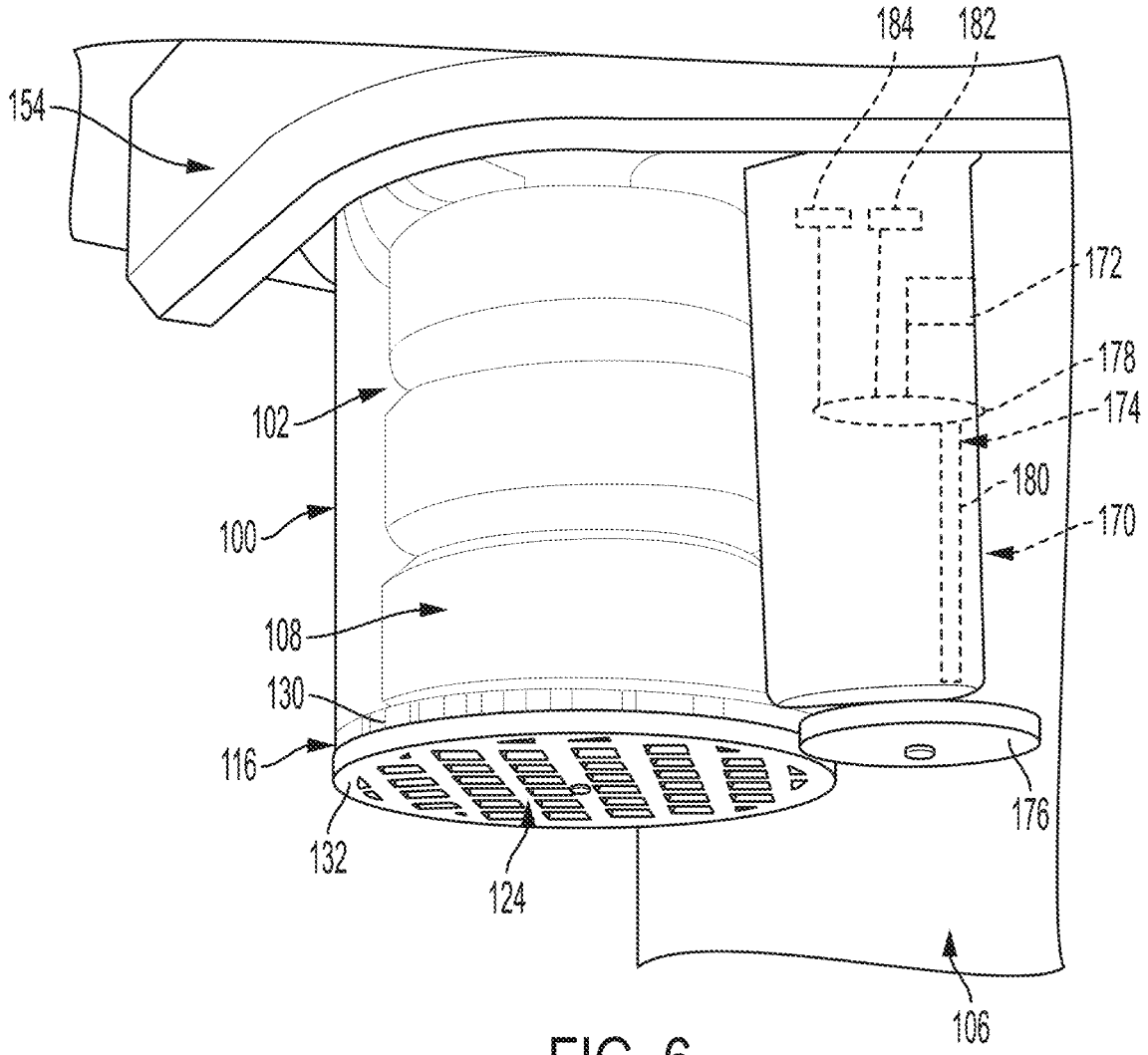
FIG. 6 is a perspective view of the dispenser of FIG. 1 further including an open area adjustment device.

FIG. 6 shows a perspective view of the dispenser 100 of FIG. 1 further including an open area adjustment device 170. As explained previously, the solid product holder 102 can be configured to facilitate control over the amount of chemistry present in the output solution by adjusting the amount of liquid that is received within the internal volume via the open area 124. As described previously, to adjust the amount of liquid that is received within the internal volume, and thus adjust the rate of dissolution and amount of chemistry present in the output solution, one of the plates 130, 132 can be movable relative to the other. In this way, alignment amongst of the first set of the plurality of apertures defined at the first plate 130 and the second set of the plurality of apertures defined at the second plate 132 can be varied by relative movement of one of the plates 130, 132 thereby correspondingly adjusting the open area 124. In some cases, the open area 124 can be varied by the open area adjustment device 170.

The open area adjustment device 170 can be configured to adjust the open area 124 at which the liquid is received at the solid product holder 102 and may thereby act to control the rate of dissolution of the solid product 108 and amount of chemistry present in the output solution. This could include increasing or decreasing (e.g., closing off) the open area 124. In the embodiment shown here, the open area adjustment device 170 includes a power source 172, a motor 174, and a drive member 176. The motor 174 is connected to the power source 172 and can be configured to convey motive force to the drive member 176. The motor 174 can take any number of suitable forms, and in the example shown here includes a rotor 178 and a drive shaft 180. When activated, the motor 174 can act to drive the drive member 176, such as via the drive shaft 180 or other suitable mechanism. The drive member 176 is shown here as interfacing with the second plate 132. The drive member 176 can also take any number of suitable forms, and in one example can be a gear having teeth that mesh with corresponding teeth on the second plate 132. When the drive member 176 is driven, the drive member 176 can be configured to move (e.g., rotate) the second plate 132 relative to the first plate 130 so as to adjust the open area 124 at which the liquid is received at the solid product holder 102.

In some cases, the open area adjustment device 170 can serve to provide an automated open area adjustment function. For example, the dispenser 100 may include one or more feedback mechanisms that are in communication with the open area adjustment device 170 so as to activate the open area adjustment device based on a particular circumstance. In one such embodiment, the dispenser 100 can include a timer 182. The timer 182 can be in communication with the open area adjustment device 170 (e.g., directly or through a controller, such as a programmable processor, of the dispenser). The timer 182 can be configured to output a signal, for instance once a preset amount of time has elapsed, that causes the open area adjustment device 170 to actuate the motor 174 so that the drive member 176 is driven to adjust the open area 124 at which the liquid is received at the solid product holder 102. As such, the timer 182 can facilitate open area adjustments at preset times and thereby can allow the solid product holder 102 to control an amount of chemistry present in the output solution.

In another such automated open area adjustment embodiment, the dispenser 100 can include a sensor 184. The sensor 184 can be in communication with the open area adjustment device 170 (e.g., directly or through a controller, such as a programmable processor, of the dispenser). The sensor 184 can be configured to detect a use device 106 condition and based on the use device 106 condition the sensor can be configured to output a signal that causes the open area adjustment device 170 to actuate the motor 174 so that the drive member 176 is driven to adjust the open area 124 at which the liquid is received at the solid product holder 102.

The sensor 184 can be any one of a variety of suitable sensors for detecting a condition at the use device 106, depending on the particular application of the dispenser 100, and based on such condition output a signal that causes the open area adjustment device 170 to adjust the open area 124. For example, the sensor 184 could be configured to detect instances when a door of the use device 106 is brought to a closed position (e.g., by detecting a change in the amount of light present). As another example, the sensor 184 could be configured to detect when a command is input at the use device 106 to start an operation at the use device 106, such as the activation of a start button at the use device 106, for instance by placing the sensor 184 in communication with the use device 106. Similarly, the sensor 184 could be in communication with a logic controller/board of the use device 106 to detect one or more input/output conditions at the use device 106. For instance, where the use device 106 is a warewashing machine, the sensor 184 could be in communication with the warewashing machine's logic controller to detect when the warewahing machine is terminating one cycle (e.g., a rinse cycle) in an operation and beginning another cycle (e.g., a wash cycle) in the operation so that the amount of chemistry in the dispensed solution can be adjusted as appropriate for a particular cycle. In a further example, again where the use device 106 is a warewashing machine, the sensor 184 could be configured to detect movement of the spray arm. In an additional example, the sensor 184 could be configured to detect conductivity of the solution being output by the dispenser 100 and/or conductivity of an end use solution at the use device (e.g., measured at a sump of the use device where solution is collected to be discarded from the use device). For instance, where the sensor 184 measures conductivity, a signal can be output to cause the open area adjustment device 170 to adjust the open area 124 a degree corresponding to a target concentration of the solution output by the dispenser 100 and/or conductivity of an end use solution at the use device. In another example, the sensor 184 could be configured to detect temperature of the liquid present in the ambient environment of the use device 106. In some embodiments, the dispenser 100 can include two or more sensors for detecting any conditions described herein.

In other cases, for instance where the dispenser 100 does not include the open area adjustment device 170, the dispenser may include one or more features useful for manual adjustment of the open area 124. Manual adjustment of the open area 124 could include user-applied force to move one of the plates 130, 132 relative to the other of the plates 130, 132. To assist in such manual adjustment, the base 116 may include one or more user-perceptible markings corresponding to open area adjustments. For example, the second plate 132 could include spaced apart tabs or numbering indicators that corresponding to a degrees of alignment between the second set of the plurality of apertures in the second plate 132 and the first set of the plurality of apertures in the first plate 130, and thus to the amount of liquid that is receivable through the open area 124 at that particular relative plate orientation.

Figure 7:
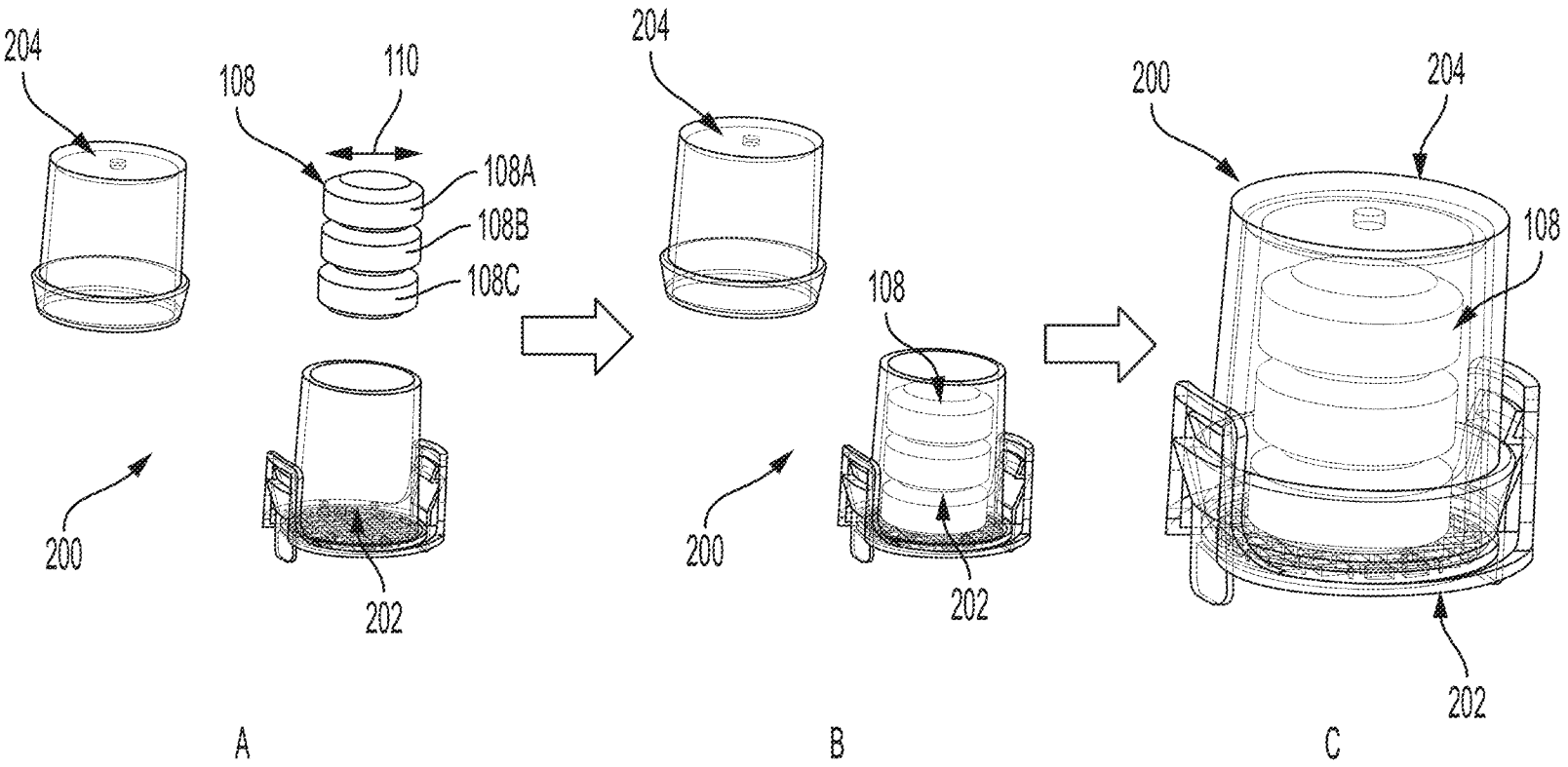
FIG. 7 is a diagram illustrating a sequence involving another exemplary embodiment of a dispenser. Each of FIGS. 7A, 7B, and 7C illustrates a portion of the sequence for ultimately removably securing a solid product holder of the dispenser to a dock of the dispenser.

FIG. 7 shows a diagram illustrating a sequence involving another exemplary embodiment of a dispenser 200. The dispenser 200 includes a solid product holder 202 and a dock 204. FIG. 7 shows a sequence of removably securing the solid product holder 202 of the dispenser 200 to the dock 204 of the dispenser 200. The dispenser 200 can be used to create a solution by dissolving a solid product 108 with a liquid. This solution can be output from the dispenser 200 to a use device and employed in an operation run at the use device as described elsewhere herein. In referring to the dispenser 200, like numerals as for the dispenser 100 are used to denote like elements of the dispenser 200. As such, in some cases, but where described or depicted as different herein, the dispenser 200 can have the same, or similar, elements as that disclosed with respect to the dispenser 100.

At portion A of the sequence shown in FIG. 7, solid product 108 is loaded into the solid product holder 202 where the solid product 108 is held. At least one of the dock 204 and the solid product holder 202 can include a transparent surface so that the solid product 108 held at the dispenser 200 is visible therethrough. The solid product 108 can be a solid-form chemistry used in one or more operations run at the use device. The type of chemistry included in the solid product 108 can vary depending on the use device with which the dispenser 200 is intended to be used. The solid product 108 is shown in the example here in the form of a number of individual solid product pucks 108A, 108B, and 108C and the solid product holder 202 may be configured to hold two or more solid product pucks, such as each of the solid product pucks 108A, 108B, and 108C. As shown in the example here, the solid product holder 202 can be configured to hold the solid product pucks 108A, 108B, and 108C in a stacked arrangement along a generally common axis extending through the solid product holder 202. The solid product holder 202 can have an internal volume for holding the solid product 108 that accommodates only one solid product puck width 110 thereacross such that the solid product pucks 108A, 108B, and 108C are loaded into the solid product holder 102 one on top of the other on the common axis extending through the solid product holder 202.

At portion B of the sequence shown in FIG. 7, once the solid product 108 is loaded into the solid product holder 202, the solid product holder 202 can be removably secured to the dock 204. The dock 204 can be configured to be fixed in place at the use device, for instance such as fixed in place within an interior of the use device. The solid product holder 202 can be moved relative to the dock 204 to removably secure the solid product holder 202 at the dock 204. In the illustrated embodiment, once the solid product holder 202 is appropriately aligned with the dock 204, the solid product holder 202 is removably secured to at the dock 204 by bringing the solid product holder 202 into contact with the dock 204. As detailed further herein, the dock 204 can include one or more features configured to receive and secure the solid product holder 202 at the dock 204 as well as to allow the solid product holder 202 to be selectively released from the dock 204 when desired (e.g., to refill the solid product holder 202 with solid product 108).

At portion C of the sequence shown in FIG. 7, the solid product holder 202 is secured to the dock 204. As noted, the dock 204 can be configured to be fixed in place within the use device and, accordingly, when the solid product holder 202 is secured to the dock 204 the solid product holder 202 can also be configured to be secured within the use device. In this way, the dispenser 200 can output a solution within the use device. For instance, the solid product holder 202 can receive a liquid, such as water, from the interior of the use device and the solid product 108 held at the solid product holder 202 can be dissolved by the received liquid to create the solution that is output within the use device from the dispenser 200. In various embodiments, the dispenser 200 can receive liquid that is freely employed (e.g., sprayed) within the use device and as such the dispenser 200 need not have a dedicated liquid feed line connected to it. As such, the dispenser 200 may be configured to create a solution by dissolving the solid product with a liquid without the dispenser 200 being connected to a plumbed liquid feed line. In examples where the use device is a warewashing machine, the dispenser 200 can receive the pressurized liquid spray from the spray arm as detailed with respect to the embodiment of FIG. 1.

Figure 8:
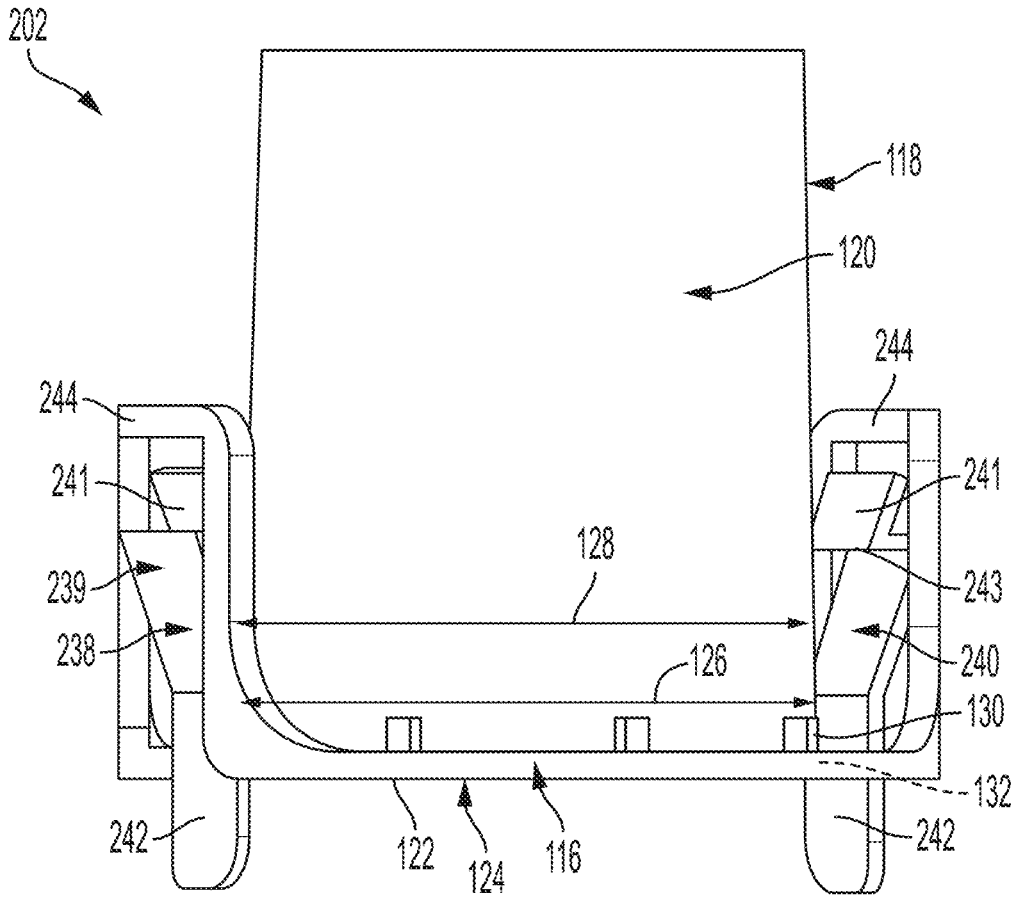
FIG. 8 is an elevational view of the solid product holder of the dispenser of FIG. 7 in isolation.

FIG. 8 shows, in isolation, an elevational view of the solid product holder 202 of the dispenser of FIG. 7. As noted, the solid product holder 202 can be configured to hold solid product and receive liquid thereat to dissolve the solid product and output a solution including chemistry of the solid product. The solid product holder 202 can include the base 116 and the support structure 118. The support structure 118 can extend from the base 116 and define the internal volume 120 for holding the solid product at the solid product holder 202. In the illustrated embodiment, the support structure 118 is a continuous surface extending about a perimeter of the base 116 and can be a transparent surface so that the solid product held within is visible through the support structure 118. The base 116 can define the plurality of apertures 122 that form the open area 124 at which the liquid is received at the solid product holder 202. In this example, the internal volume 120 can be further defined by the base 116 such that the solid product holder 202 is configured to communicate the received liquid through the plurality of apertures 122 into the internal volume 120 where the solid product is held and dissolved when the liquid is received therein. In addition, the solid product holder 202 may be configured to output the solution at the plurality of apertures 122 such that the open area 124 formed by the plurality of apertures 122 can serve as an outlet area for the created solution.

In the same, or similar, manner as that described with respect to the solid product holder 102, the solid product holder 202 can be configured to facilitate generally even dissolution across an exposed surface of the solid chemistry (e.g., a bottom surface of the bottom-most solid chemistry puck) using the liquid received at the open area 124. Namely, as detailed previously, the plurality of apertures 122 can be defined across the first cross-sectional area 126 of the base 116 and the internal volume 120 can be defined across the second cross-sectional area 128 of the support structure 118 where the first cross-sectional area 126 can approximate, and in one case can be equal to, the second cross-sectional area 128.

In the same, or similar, manner as that described with respect to the solid product holder 102, the solid product holder 202 can be configured to facilitate control over the amount of chemistry present in the output solution by adjusting the amount of liquid that is received within the internal volume 120 via the open area 124. Namely, as detailed previously, the base 116 can include the first plate 130 and a second plate 132 where, for instance, the second plate 132 can be movable at the solid product holder 202 relative to the first plate 130. By moving the second plate 132 relative to the first plate 130, a degree to which the apertures 122 of the respective plates 130, 132 are aligned can be adjusted to correspondingly alter the open area 124 at which the liquid is received at the solid product holder 202. Likewise, as also detailed previously, the first plate 130 can define a first set of the plurality of apertures 122 and the second plate 132 can define a second set of the plurality of apertures 122. And, moving the second plate 132 relative to the first plate 130 can vary alignment between the first set of the plurality of apertures 122 and the second set of the plurality of apertures 122 and thereby adjust the open area 124 at the base 116 of the solid product holder 202. This allows the base 116 to be configured to adjust the open area 124 at which the liquid is received at the solid product holder 202 by movement of the second plate 132 relative to the first plate 130.

The solid product holder 202 can be configured to be removably secured to the dock of the dispenser. As shown in the exemplary embodiment in FIG. 8, the solid product holder 202 can include a retaining structure 238 that is configured to removably secure the solid product holder 202 to the dock. In this example, the retaining structure 238 includes a first cam 239 and a second cam 240 for interfacing with the dock and facilitating a secure yet removable connection between the solid product holder 202 and the dock. Here, each cam 239, 240 can include a first cam end 241 and a second cam end 242. The second cam end 242 can be opposite the first cam end 241 as shown in the illustrated embodiment. The first cam end 241 can include a retaining surface 243. As shown and described further elsewhere, the retaining surface 243 can be configured to attach to a receiving surface at the dock of the dispenser.

Each cam 239, 240 can be movable between a secured position and a released position. When each cam 239, 240 is at the secured position the retaining surface 243 can be attached to the receiving surface of the dock, whereas when each cam 239, 240 is at the release position the retaining surface 243 can be brought off of the receiving surface of the dock. In some examples, each cam 239, 240 can be biased to the secured position. Moreover, in some such examples, the each cam 239, 240 can be brought to the release position by applying force (e.g., a user pressing) at the second cam end 242. As such, the each cam 239, 240 may pivot from the secured position to the released position by interacting with the second cam end 242. As shown in the present example, the solid product holder 202 may include a protective guard 244 adjacent to each cam 239, 240. The protective guard 244 can form surround a portion, or all of, each cam 239, 240 and thereby serve to protect each cam 239, 240 during dispenser use in various applications.

Figure 9:
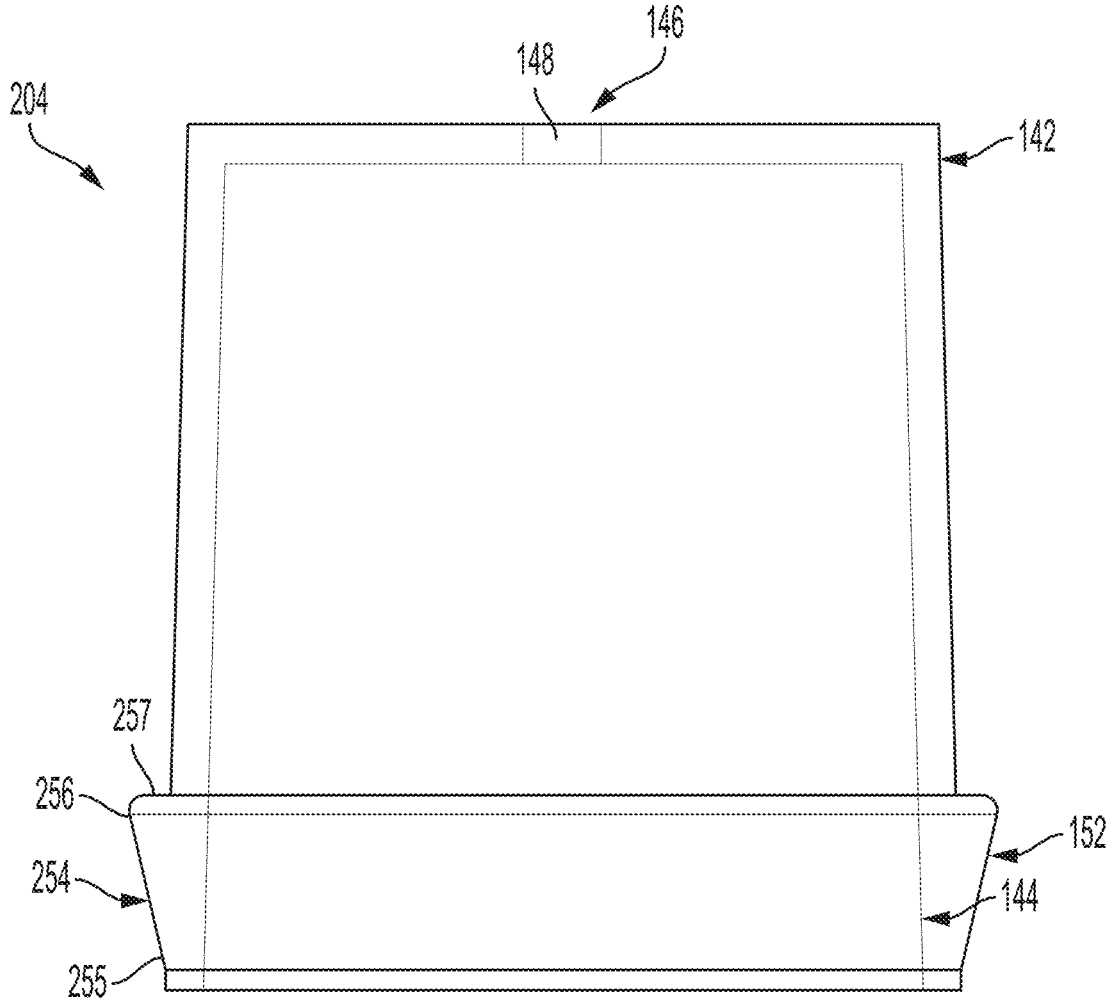
FIG. 9 is an elevational view of the dock of the dispenser of FIG. 7 in isolation.

FIG. 9 shows an elevational view of the dock 204 of the dispenser of FIG. 7 in isolation. The dock 204 can have the first portion 142 and the second portion 144. In the illustrated example, the first portion 142 is a first surface of the dock 204 and the second portion 144 is a second, opposite surface of the dock 204. Here, the first portion 142 can define a closed surface (e.g., except at the location of the fixation bore 148), at least at a location where the first portion 142 forms an end surface of the dock 204. The second portion 144 can define an opened area at a location where the second portion 144 forms an end surface of the dock 204 and receives the solid product holder.

As noted previously, the dock 204 can be configured to be fixed in place at the use device. The first portion 142 of the dock 204 can include the fixation element 146 that is configured to fix the dock in place at the use device. In the illustrated example, the fixation element 146 includes the fixation bore 148 and a fastener (shown, e.g., as 150 in FIG. 10). The fixation bore 148 can extend into, and in some cases through, the first portion 142 of the dock 204. The fastener can be received at the fixation bore 148 and be configured to extend into, and thereby fix the dock 204 at, a surface of the use device. A sealing member, such as gasket, may also be included at an interface of the fastener and fixation bore 148.

As also noted previously, the dock 204 can be configured to removably secure the solid product holder thereat. The second portion 144 of the dock 204 can include the receiving structure 152 at which the retaining structure of the solid product holder can be removably secured. In the illustrated embodiment, the receiving structure 152 includes a protruded lip 254. The protruded lip 254 can extend around some, or all, of a perimeter of the dock 204 at the second portion 144. As shown here, the protruded lip 254 can include a first lip end 255 and a second lip end 256. The protruded lip 254 can extend out from the second portion 144 at the first lip end 255 and can form a receiving surface 257 at the second lip end 256. The receiving surface 257 can be configured to allow the retaining surface of each cam of the solid product holder to be attached thereat. In the embodiment shown here, the receiving surface 257 can extend around an entire perimeter of the dock 204 at the second portion 144 which can be useful in allowing the solid product holder to be secured to the dock regardless of the angular orientation of the solid product holder when it is being secured thereat.

The protruded lip 254 can define a geometry that facilitates removably securing the solid product holder at the dock 204. As shown in the illustrated example, the protruded lip may include a frustoconical shape. In particular, the frustoconical shape included at the protruded lip 254 may taper in a direction from the second lip end 256 toward the first lip end 255. For instance, the protruded lip 254 can define an extension out from the second portion 144 that is greater at, or near, the second lip end 256 than at, or near, the first lip end 255. Such a geometry may be useful in removably securing the solid product holder at the dock 204.

Figure 10:
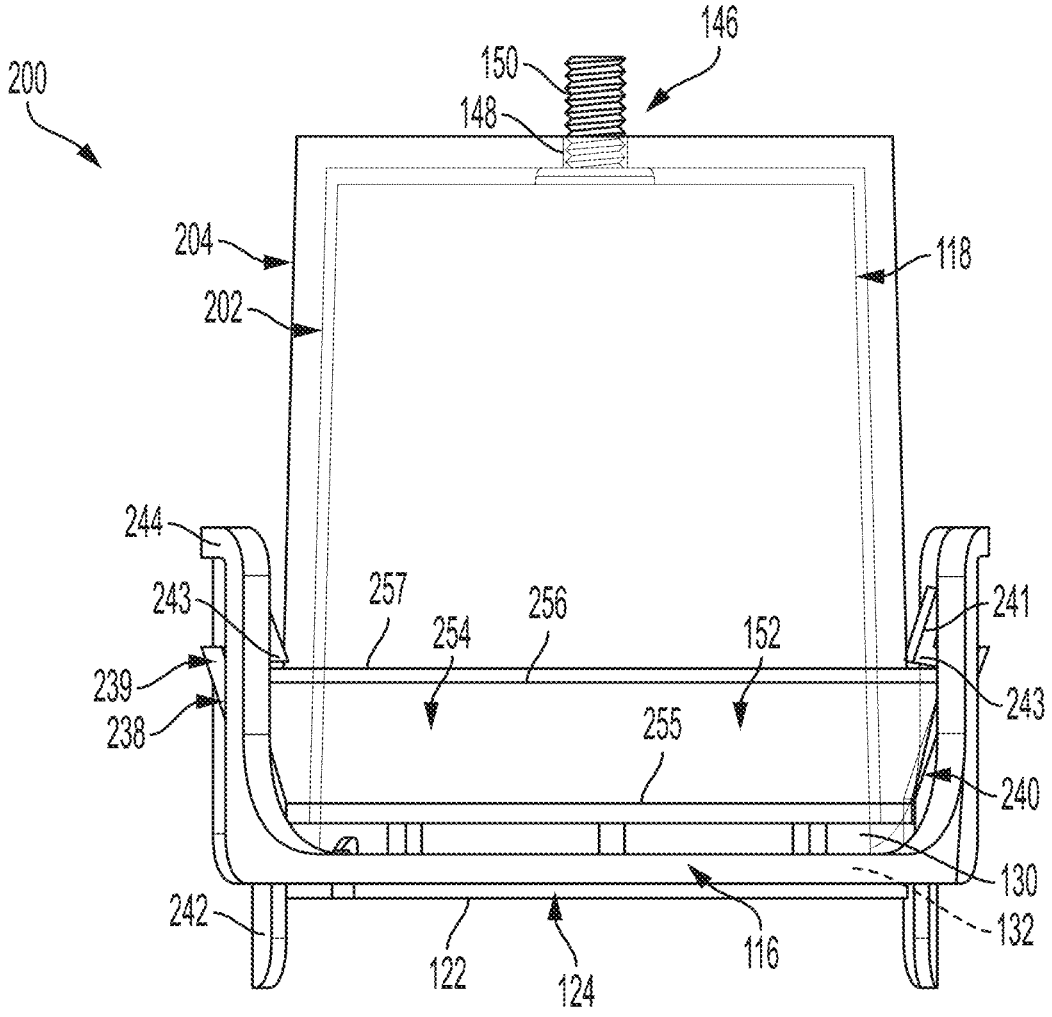
FIG. 10 is an elevational view of the dispenser of FIG. 7 showing the solid product holder secured to the dock.

FIG. 10 shows an elevational view of the dispenser 200 of FIG. 7 with the solid product holder 202 secured to the dock 204. As shown here, the retaining structure of the solid product holder 202 is secured to the receiving structure of the dock 204. In particular, in this embodiment, the retaining surface 243 of each cam 239, 240 of the solid product holder 202 can be configured to attach to the receiving surface 257 of the protruded lip 254 to secure the solid product holder 202 to the dock 204. As noted, in embodiments where the receiving surface 257 spans around a perimeter of the dock 204, the solid product holder 202 may be able to be removably secured to the dock 204 via each cam 239, 240 regardless of the angular orientation of the solid product holder 202 when it is being secured at the dock 204. This can enhance convenience and usability of the dispenser, for instance, by improving ergonomics associated with the dispenser.

In the embodiment shown here, when the solid product holder 202 is to be removably secured at the dock 204, the support structure 118 can be positioned within the interior of the dock 204 by moving the support structure 118 through the opening at the second portion of the dock 204. As the solid product holder 202 is moved relative to the dock 204, the first cam end 241 of each cam 239, 240 will come into contact with the first lip end 255 of the protruded lip 254. As the first cam end 241 of each cam 239, 240 comes into contact with the first lip end 255 and is moved along the protruded lip 254, each cam 239, 240 can be moved from the secured position, to which each cam 239, 240 may be biased, to the released position. Thus, the protruded lip 254 can move the retaining surface 243 of each cam 239, 240 away from the base 116 as the first cam end 241 of each cam 239, 240 is moved along the protruded lip 254 in a direction from the first lip end 255 toward the second lip end 256. Then, when the first cam end 241 of each cam 239, 240 reaches the second lip end 256, the bias on each cam 239, 240 can act bring the retaining surface 243 back toward the base 116 to attach the retaining surface 243 of each cam 239, 240 to the receiving surface 257 at the second lip end 256. As shown in FIG. 10, each cam 239, 240 is at the secured position where the retaining surface 243 at the first cam end 241 is attached to the receiving surface 257 at the second lip end 256. In some cases, each cam 239, 240 and the protruded lip 254 can be configured such that the retaining surface 243 of each cam 239, 240 snaps onto the receiving surface 257 of the protruded lip 254 so as to provide the user with a tactile indication that the solid product holder 202 has been successfully secured at the dock 204. Moreover, the attachment of the retaining surface 243, of each cam 239, 240, to the receiving surface 257 can help to keep the solid product holder in place at the dock 204 during operation of the use device, which may include the ability to withstand vibrational forces imparted onto the dispenser during operation of the use device.

When the solid product holder 202 is to be removed from the dock 204, each cam 239, 240 can be moved from the secured position, shown in FIG. 10, to the released position at which the retaining surface 243 at the first cam end 241 is off of the receiving surface 257 at the second lip end 256. In embodiments where each cam 239, 240 is biased to the secured position, force can be applied to the second cam end 242 to overcome the bias to the secured position and bring the retaining surface 243 off of the receiving surface 257. Then, as the first cam end 241 is moved along the protruded lip 254 in a direction from the second lip end 256 toward the first lip end 255, the bias of each cam 239, 240 to the secured position can be overcome when the retaining surface 243 is at a location along the frustoconical shape of the protruded lip 254. In this way, a user may only need to apply force to the second cam end 242 to overcome the bias to the secured position initially to move the retaining surface off of the receiving surface 257 and the protruded lip 254 can continue to overcome the bias on each cam 239, 240 as the solid product holder 202 is moved out from the dock 204.

Figure 11:
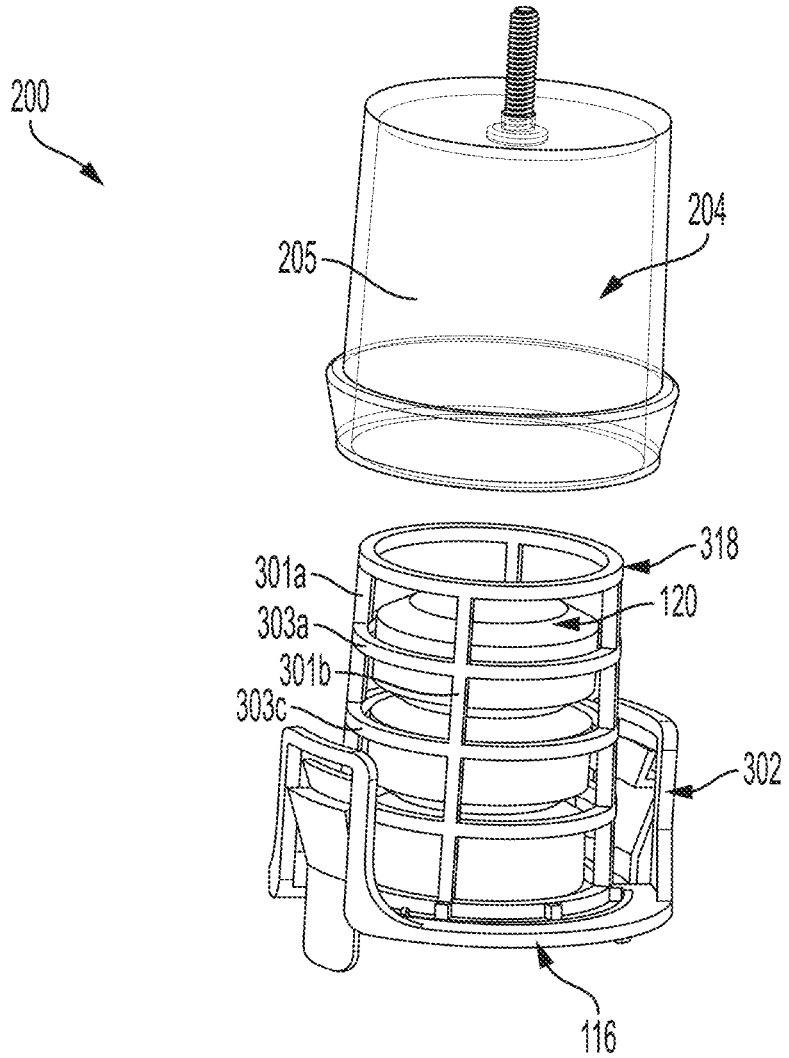
FIG. 11 is an exploded perspective view of the dispenser of FIG. 7 having a different exemplary embodiment of a solid product holder.

FIG. 11 shows an exploded perspective view of the dispenser 200 having a different exemplary embodiment of a solid product holder 302. Except as otherwise noted herein with respect to the support structure 318, the solid product holder 302 can be the same as, or similar to, that described and depicted previously herein with respect to the solid product holder 202.

As shown in FIG. 11 the solid product holder 302 can include the support structure 318. The illustrated embodiment of the support structure 318 includes a number of vertical support ribs 301*a*, 301*b* and a number of horizontal support ribs 303*a*, 303*b*. A first vertical support rib 301*a* can be spaced from a second vertical support rib 301*b* about the base 116. A first horizontal support rib 303*a* can be spaced from a second horizontal support rib 303*b* relative to the vertical support ribs 301*a*, 301*b*. As such, the support structure 318 can define a number of opening each between adjacent vertical support ribs 301*a*, 301*b* and adjacent horizontal support ribs 303*a*, 303*b*. Where the support structure 318 is not made of a transparent material, such openings may be useful to identify an amount of solid product remaining within the solid product holder 302.

As also shown here, the dock 204 can include a continuous surface 205. The continuous surface 205 may extend around a perimeter of the dock 204 and define a solid surface lacking any openings thereat (the fixation bore may be present, e.g., at the first portion of the dock 204). Accordingly, when the support structure 318 defines the openings, the continuous surface 205 of the dock 204 can shield the internal volume 120, which can be configured to hold the solid product, when the solid product holder 302 is secured to the dock 204. Shielding provided by the continuous surface 205 can help to facilitate uniform dissolution described previously across that surface of the solid product sitting at the base 116. Moreover, some, or all, of the continuous surface 205 can include a transparent surface so that the amount of solid product remaining within the solid product holder 302 can be ascertained when the solid product holder 302 is secured to the dock 204.

Figure 12:
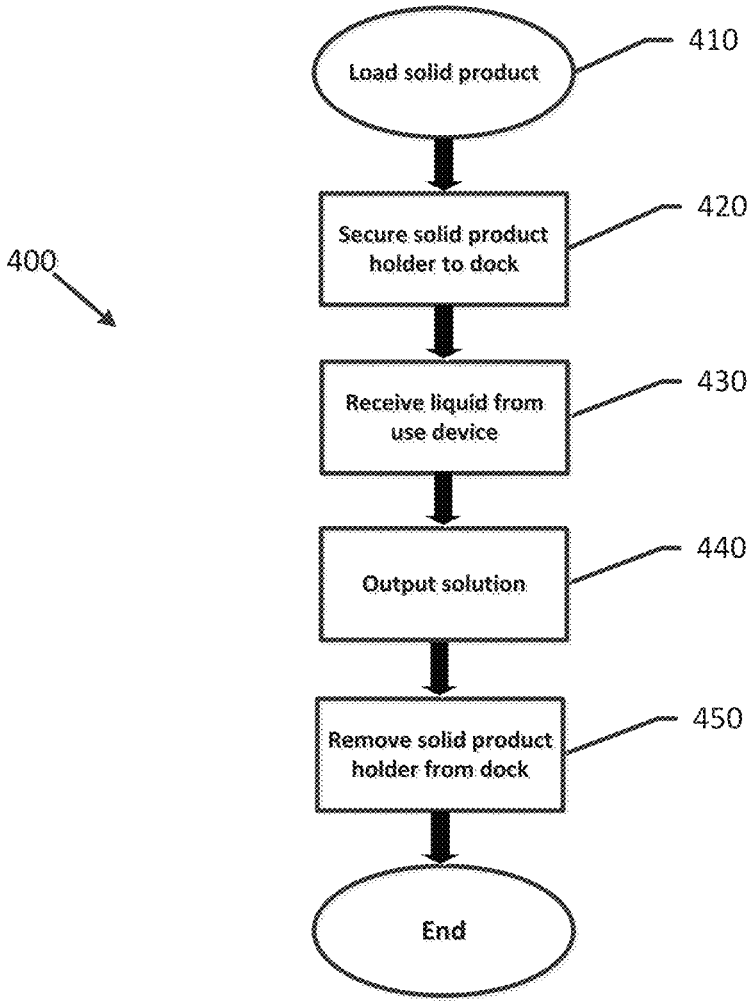
FIG. 12 is a flow diagram of an exemplary embodiment of a method of creating a solution by dissolving a solid product with a liquid.

FIG. 12 shows a flow diagram of an exemplary embodiment of a method 400 of creating a solution by dissolving a solid product with a liquid. At step 410, solid product is loaded into a solid product holder. The solid product can be the same as, or similar to, the solid product examples described elsewhere herein. Likewise, the solid product holder can be the same as, or similar to, the solid product holder examples described elsewhere herein. For instance, the solid product holder can have a base defining a plurality of apertures that form an open area at which liquid is received at the solid product holder. Such solid product holder can also include a support structure that extends from the base and defines an internal volume for holding the solid product at the solid product holder. A width of this internal volume can approximate a width of the solid product such that the liquid received at the open area is limited to confronting a surface of the solid product interfacing with the open area.

At step 420, the solid product holder is secured to a dock. The dock can be the same as, or similar to, the dock examples described elsewhere herein. For instance, the dock can have a first portion that includes a fixation element for fixing the dock in place at a use device and a second portion that includes a receiving structure. The solid product holder can be secured to the dock, for instance, by securing a retaining structure of the solid product holder to a receiving structure of a dock as detailed for examples elsewhere herein.

At step 430, liquid can be received from the use device at the internal volume defined by the support structure through the open area. When liquid is received at the internal volume, this liquid can act to dissolve a surface of the solid product interfacing with the open area at the base of the solid product holder. As detailed elsewhere herein, the liquid that is received via the open area can be liquid sprayed, or otherwise output, into the ambient environment of the use device prior to being received at the open area. Accordingly, in some cases, the solid product holder may lack a liquid feed line connection thereat since liquid output into the ambient environment of the use device can be received at the internal volume of the solid product holder and need not come from a feed line connected to the dispenser. Indeed, in certain such cases, the dispenser can be configured to receive liquid input thereat only through the plurality of apertures at the base of the solid product holder. The dispenser can be configured to have the plurality of apertures at the base interfacing directly with the ambient environment of the use device as well as one or more continuous surfaces at all other exterior surfaces of the dispenser (e.g., exterior surfaces as defined when the solid product holder is secured to the dock) that shield that the internal volume, where the solid product is held, from receiving liquid input.

At step 440, the solution can be output from the dispenser at the open area. The solution can be created as the received liquid dissolves the solid product held at the internal volume defined by the solid product holder. As such, the solution can include chemistry of the solid product held at the internal volume and the liquid received at the solid product holder.

In a further embodiment, the method 400 can include a step of adjusting the open area. This can be done, for instance, either manually or in an automated manner by moving one plate having a set of apertures of the open area relative to another plate having a set of apertures of the open area. Adjusting the open area can be useful in facilitating control over dissolution of the solid product and thus adjusting the concentration of chemistry present in the output solution. Such a step of adjusting the open area can occur before or after any step described here, and may even be performed multiple times each before or after any steps described here.

At step 450, the solid product holder is removed from the dock. The solid product holder can be removed from the dock, for instance, by unsecuring the retaining structure of the solid product holder from the receiving structure of the dock. In one example, this could include moving a catch of the solid product holder off of a track surface at a flange of the dock. In another example, this could include moving one or more cams from a secured position, where a retaining surface of the cam is attached to a receiving surface at a protruded lip of the dock, to a released position, where the retaining surface of the cam is off of the receiving surface at the protruded lip of the dock.

Various non-limiting exemplary embodiments have been described. It will be appreciated that suitable alternatives are possible without departing from the scope of the examples described herein. These and other examples are within the scope of the following claims.

What is claimed is:

1. A dispenser for creating a solution by dissolving a solid product with a liquid, the dispenser comprising:

a dock configured to be fixed in place at a use device that comprises a warewashing machine, the dock having a first portion and a second portion, the first portion including a fixation element that is configured to fix the dock in place at the use device, the second portion including a receiving structure;

a solid product holder configured to be removably secured to the dock, the solid product holder comprising:

a retaining structure configured to removably secure the solid product holder to the receiving structure at the second portion of the dock;

a base defining a plurality of apertures that form an open area at which the liquid is received at the solid product holder, wherein the base comprises a first plate and a second plate, wherein the first plate defines a first set of the plurality of apertures and the second plate defines a second set of the plurality of apertures, and wherein the second plate is movable at the solid product holder relative to the first plate; and a support structure extending from the base and defining an internal volume for holding the solid product at the solid product holder;

an open area adjustment device that includes a power source, a motor connected to the power source, and a drive member driven by the motor and interfacing with the second plate, wherein the drive member, when driven, is configured to move the second plate relative to the first plate so as to adjust the open area at which the liquid is received at the solid product holder; and a sensor in communication with the open area adjustment device, the sensor configured to detect a use device condition comprising termination of one operational cycle and initiation of another operational cycle at the warewashing machine, wherein based on the use device condition the sensor is configured to output a signal to cause the open area adjustment device to actuate the motor so that the drive member is driven to adjust the open area at which the liquid is received at the solid product holder.

2. The dispenser of claim 1, wherein the plurality of apertures are defined across a first cross-sectional area of the base and the internal volume is defined across a second cross-sectional area of the support structure, and wherein the first cross-sectional area approximates the second cross-sectional area.

3. The dispenser of claim 1, wherein the base is configured to adjust the open area at which the liquid is received at the solid product holder by movement of the second plate relative to the first plate.

4. The dispenser of claim 1, further comprising:

a timer in communication with the open area adjustment device, wherein the timer is configured to output a signal that causes the open area adjustment device to actuate the motor so that the drive member is driven to adjust the open area at which the liquid is received at the solid product holder.

5. The dispenser of claim 1, wherein at least one of the dock and the solid product holder comprises a transparent surface.

6. The dispenser of claim 1, wherein the internal volume is further defined by the base such that the solid product holder is configured to communicate the liquid through the plurality of apertures into the internal volume, and wherein the solid product holder is configured to output the solution at the plurality of apertures.

7. The dispenser of claim 1, wherein the receiving structure comprises a flange that extends out from the second portion, and wherein the flange forms a track surface at a location on the flange that is spaced from the second portion.

8. The dispenser of claim 7, wherein the flange forms an opened flange end and a closed flange end, wherein the track surface extends from a first track surface end to a second track surface end, and wherein the first track surface end and the second track surface end are at the opened flange end.

9. The dispenser of claim 8, wherein the retaining structure of the solid product holder comprises a catch that is configured to sit on the track surface.

10. The dispenser of claim 8, wherein the receiving structure comprises a locking mechanism at a location along the track surface between the opened flange end and the closed flange end.

11. The dispenser of claim 10, wherein the locking mechanism is configured to secure the solid product holder to the dock when the retaining structure of the solid product holder is moved along the track surface and past the locking mechanism, and wherein the locking mechanism is configured to unsecure the solid product holder from the dock upon the retaining structure of the solid product holder being brought into contact with the locking mechanism.

12. The dispenser of claim 1, wherein the receiving structure comprises a protruded lip having a first lip end and a second lip end, wherein the protruded lip extends out from the second portion at the first lip end and forms a receiving surface at the second lip end.

13. The dispenser of claim 12, wherein the retaining structure of the solid product holder comprises a cam having a first cam end with a retaining surface and a second cam end opposite the first cam end, and wherein the retaining surface at the first cam end is configured to attach to the receiving surface at the second lip end to secure the solid product holder to the dock.

14. The dispenser of claim 13, wherein the protruded lip includes a frustoconical shape so as to taper in a direction from the second lip end toward the first lip end.

15. The dispenser of claim 14, wherein the cam has a secured position at which the retaining surface at the first cam end is attached to the receiving surface at the second lip end and a released position at which the retaining surface at the first cam end is off of the receiving surface at the second lip end, wherein the cam is biased to the secured position, and wherein the bias of the cam to the secured position is overcome when the retaining surface at the first cam end is at a location along the frustoconical shape.

16. The dispenser of claim 12, wherein the support structure comprises a first vertical support rib and a second vertical support rib that is spaced about the base from the first vertical support rib, and wherein the dock comprises a continuous surface that shields that the internal volume for holding the solid product when the solid product holder is secured to the dock.

* * * * *